US005743305A

United States Patent [19]

Tamura et al.

[11] Patent Number: 5,743,305

[45] Date of Patent: Apr. 28, 1998

[54] SHEDDING CONTROL METHOD BASED ON STORED SHEDDING CURVES

[75] Inventors: Zenji Tamura; Satoshi Azuma, both of Kanazawa, Japan

[73] Assignee: Tsudakoma Kogyo Kabushiki Kaisha, Kanazawa, Japan

[21] Appl. No.: 733,326

[22] Filed: Oct. 17, 1996

[30] Foreign Application Priority Data

Oct. 18, 1995 [JP] Japan ..... 7-294884
Sep. 5, 1996 [JP] Japan ..... 8-253976

[51] Int. Cl.[6] ..... D03C 13/00; D03C 17/06; D03D 51/02

[52] U.S. Cl. ..... 139/1 E; 139/55.1; 139/57; 364/470.11

[58] Field of Search ..... 139/1 E, 57, 55.1; 364/470.11, 921.1

[56] References Cited

U.S. PATENT DOCUMENTS 4,953,596 9/1990 Takegawa ..... 139/55.1
5,228,480 7/1993 Tamura ..... 139/1 E
5,273,079 12/1993 Beyaert et al. ..... 139/57

FOREIGN PATENT DOCUMENTS 513 728 11/1992 European Pat. Off. .
4-300339 10/1992 Japan .
4-308243 10/1992 Japan .
06322644 11/1994 Japan ..... 139/1 E

*Primary Examiner*—Andy Falik
*Attorney, Agent, or Firm*—Wenderoth, Lind & Ponack

[57] ABSTRACT

In an electric shedding control apparatus, shedding patterns are stored in memories in such a manner that the shedding patterns are compressed and the time required to read the shedding patterns is shortened. An electric shedding apparatus is provided for driving each of a plurality of heddle frames independently and in synchronization with a rotation of a main shaft of a loom. Constituents of the shedding operations are set in advance, and the constituents are selected for each shedding step. Also, in order to drive the heddle frame, shedding amount instruction for the heddle frame is output in accordance with the rotation of the loom main shaft based on a shedding curve which includes the selected constituents.

6 Claims, 23 Drawing Sheets

[SHEDDING PATTERNS]

[CONTENT OF SETTING OF SHEDDING SELECTION INSTRUCTION]

| Sp | HEDDLE FRAME NO. | | | | | |
|---|---|---|---|---|---|---|
| | 1 | 2 | 3 | 4 | 5 | 6 |
| 1 | 0 (1) | 1 (3) | 1 (2) | 0 (1) | 1 (3) | 1 (2) |
| 2 | 1 (2) | 0 (1) | 1 (3) | 1 (2) | 0 (1) | 1 (3) |
| 3 | 1 (3) | 1 (2) | 0 (1) | 1 (3) | 1 (2) | 0 (1) |
| 4 | 0 (1) | 1 (3) | 1 (2) | 0 (1) | 1 (3) | 1 (2) |
| 5 | 1 (2) | 0 (1) | 1 (3) | 1 (2) | 0 (1) | 1 (3) |
| 6 | 1 (3) | 1 (2) | 0 (1) | 1 (3) | 1 (2) | 0 (1) |

1 : RISING
0 : LOWERING

[SHEDDING OPERATION OF NO. 1 HEDDLE FRAME]

[SHEDDING OPERATION OF NO. 1 HEDDLE FRAME WHEN REVERSELY ROTATING WHILE ITCHING]

[SHEDDING PATTERNS]

[SHEDDING PATTERNS]

[CONTENT OF SETTING OF SHEDDING SELECTION INSTRUCTION]

| Sp | HEDDLE FRAME NO. | | | | | | | |
|---|---|---|---|---|---|---|---|---|
| | 1 | 2 | 3 | 4 | 5 | | | n |
| 1 | | | | | | | | |
| i | 0 (1) | -- | -- | -- | -- | | | -- |
| i + 1 | 1 (6) | -- | -- | -- | -- | | | -- |
| i + 2 | 0 (2) | | | | | | | |
| i + 3 | 1 (9) | | | | | | | |
| i + 4 | 0 (4) | | | | | | | |
| i + 5 | 1 (7) | | | | | | | |
| i + 6 | 1 (5) | | | | | | | |
| i + 7 | 0 (3) | | | | | | | |
| i + 8 | 0 (10) | | | | | | | |
| i + 9 | 1 (6) | | | | | | | |
| i + 10 | 0 (1) | -- | -- | -- | -- | | | -- |
| ⋮ | | | | | | | | |
| | | | | | | | | |

[SHEDDING OPERATION OF NO. 1 HEDDLE FRAME]

[SHEDDING PATTERNS]

[SHEDDING PATTERNS TO BE PREPARED WHEN TWO SHEDDING PATTERNS ARE CONNECTED]

FIG.18

[ORIGINAL SHEDDING SELECTION INSTRUCTIONS]

| Sp | HEDDLE FRAME NO. | | | | | |
|---|---|---|---|---|---|---|
| | 1 | 2 | 3 | 4 | 5 | 6 |
| 1 | 0 | 1 | 1 | 0 | 1 | 1 |
| 2 | 1 | 0 | 1 | 1 | 0 | 1 |
| 3 | 1 | 1 | 0 | 1 | 1 | 0 |
| 4 | 0 | 1 | 1 | 0 | 1 | 1 |
| 5 | 1 | 0 | 1 | 1 | 0 | 1 |
| 6 | 1 | 1 | 0 | 1 | 1 | 0 |

1 : RISING
0 : LOWERING

[SHEDDING SELECTION INSTRUCTIONS IN SHEDDING STEPS WHICH ARE CONNECTED TO EACH OTHER]

| Sp | HEDDLE FRAME NO. | | | | | |
|---|---|---|---|---|---|---|
| | 1 | 2 | 3 | 4 | 5 | 6 |
| 1 | 101 (11) | 110 (12) | 011 (15) | 101 (11) | 110 (12) | 011 (15) |
| 2 | 110 (12) | 011 (15) | 101 (11) | 110 (12) | 011 (15) | 101 (11) |
| 3 | 011 (15) | 101 (11) | 110 (12) | 011 (15) | 101 (11) | 110 (12) |

[SHEDDING OPERATION OF NO. 1 HEDDLE FRAME WHEN REVERSELY ROTATING WHILE ITCHING]

[SHEDDING PATTERNS WHEN ANGLE OF MAIN SHAFT IS DIVIDED INTO TWO]

DWELL ANGLES 0°/30°

FIG.22

[ORIGINAL SHEDDING SELECTION INSTRUCTIONS]

| Sp | HEDDLE FRAME NO. 1 | 2 | 3 | 4 | 5 | 6 |
|---|---|---|---|---|---|---|
| 1 | 0 | 1 | 1 | 0 | 1 | 1 |
| 2 | 1 | 0 | 1 | 1 | 0 | 1 |
| 3 | 1 | 1 | 0 | 1 | 1 | 0 |
| 4 | 0 | 1 | 1 | 0 | 1 | 1 |
| 5 | 1 | 0 | 1 | 1 | 0 | 1 |
| 6 | 1 | 1 | 0 | 1 | 1 | 0 |

1 : RISING
0 : LOWERING

[SHEDDING SELECTION INSTRUCTIONS AFTER THE SHEDDING CURVES ARE DIVIDED INTO TWO WHEN THE LOOM OPERATES]

| Sp | HEDDLE FRAME NO. 1 | 2 | 3 | 4 | 5 | 6 |
|---|---|---|---|---|---|---|
| 1 | 0 (21) | 1 | 1 | 0 | 1 | 1 |
| 2 | 0 (24) | 1 | 1 | 0 | 1 | 1 |
| 3 | 1 (26) | 0 | 1 | 1 | 0 | 1 |
| 4 | 1 (23) | 0 | 1 | 1 | 0 | 1 |
| 5 | 1 (22) | 1 | 0 | 1 | 1 | 0 |
| 6 | 1 (22) | 1 | 0 | 1 | 1 | 0 |
| 7 | 0 (21) | 1 | 1 | 0 | 1 | 1 |
| 8 | 0 (24) | 1 | 1 | 0 | 1 | 1 |
| 9 | 1 (26) | 0 | 1 | 1 | 0 | 1 |
| 10 | 1 (23) | 0 | 1 | 1 | 0 | 1 |
| 11 | 1 (22) | 1 | 0 | 1 | 1 | 0 |
| 12 | 1 (22) | 1 | 0 | 1 | 1 | 0 |

[SHEDDING SELECTION INSTRUCTIONS AFTER THE SHEDDING CURVES ARE DIVIDED INTO TWO WHEN THE LOOM STOPS]

| Sp | HEDDLE FRAME NO. 1 | 2 | 3 | 4 | 5 | 6 |
|---|---|---|---|---|---|---|
| 1 | 0 (21) | 1 | 1 | 0 | 1 | 1 |
| 2 | 0 (24) | 1 | 1 | 0 | 1 | 1 |
| 3 | 1 (24) | 0 | 1 | 1 | 0 | 1 |
| 4 | 1 (23) | 0 | 1 | 1 | 0 | 1 |
| 5 | 1 (21) | 1 | 0 | 1 | 1 | 0 |
| 6 | 1 (23) | 1 | 0 | 1 | 1 | 0 |
| 7 | 0 (21) | 1 | 1 | 0 | 1 | 1 |
| 8 | 0 (24) | 1 | 1 | 0 | 1 | 1 |
| 9 | 1 (26) | 0 | 1 | 1 | 0 | 1 |
| 10 | 1 (23) | 0 | 1 | 1 | 0 | 1 |
| 11 | 1 (21) | 1 | 0 | 1 | 1 | 0 |
| 12 | 1 (23) | 1 | 0 | 1 | 1 | 0 |

[SHEDDING OPERATION OF NO. 1 HEDDLE FRAME]

SHEDDING CONTROL METHOD BASED ON STORED SHEDDING CURVES

BACKGROUND OF THE INVENTION

1. Field of the Invention

The present invention relates to an electric shedding motion or apparatus of a loom (hereinafter referred to as a shedding apparatus), more particularly to a technique for sequentially outputting shedding curve selection instruction and a plurality of shedding curves in response to a shedding step.

2. Prior Art

In a technique disclosed in JP-A 4-308243, a selection instruction for a shedding curve (hereinafter referred to as a shedding curve selection instruction) and a plurality of shedding curves are set in advance in response to one cycle of a loom, i.e., a shedding step of a shedding operation. In the shedding operation repeat of a texture pattern of a woven fabric, namely, one repeat shedding curves are synthesized and stored before the operation of the loom. Also, the driving amount of a heddle frame is set based on the stored shedding curve in response to the revolution of the main shaft during the operation of the loom, thereby controlling shedding operations of a plurality of heddle frames.

The prior art technique has a problem in that it requires enormous storage capacities to store shedding patterns for weaving a fabric with shedding patterns extending several thousand picks such as a dobby weaving since complete one repeat shedding curves need to be stored. That is, since the shedding apparatus of one loom requires a plurality of heddle frames, if enormous storing capacities are required for each heddle frame, the storage capacities totaled per loom or per mill become very enormous, which causes such problems that the storage capacities are reduced or wasted, control circuits become complex and the shedding apparatuses cost high. Further, there is another problem in that enormous processing time is involved in synthesizing one repeat shedding curves comprising several thousand steps.

SUMMARY OF THE INVENTION

To achieve the above object, the shedding control method of the present invention comprises setting constituents constituting a shedding operation in advance, selecting the constituents for every shedding step, outputting an instruction of shedding amount of a heddle frame based on a shedding curve comprising the selected constituents according to a main shaft of the loom, to thereby drive the heddle frame. The heddle frame is synchronized with the main shaft to perform a positional control. The constituents for constituting the shedding operation comprise, for example, dwell angles, shedding amount, and shedding switching timing, etc. The dwell angle is an angle of the main shaft at a position where the heddle frame is shed at the maximum. The shedding amount, is the amount of motion of the heddle frame which is determined corresponding to the rotation angle of the main shaft. Each shedding step is a unit for driving the heddle frame and is determined depending on the constituents.

For example, the heddle frame is driven in the manner of determining the driving unit of the heddle frame so as to be the smallest number, or angle or rotation of the main shaft preparing the shedding curve for every dwelling and movement of the heddle frame or determining the driving unit of the heddle frame according to moving direction of the heddle frame, preparing the shedding curve for each movement of the heddle frame (more specifically, including dwelling, movement, dwelling for down →up movement), selecting the shedding curve for every shedding step, outputting a shedding amount instruction of the heddle frame corresponding to the rotation of the main of the loom shaft, thereby driving the heddle frame.

According to the present invention, since the shedding selection instruction and the shedding curve data are individually stored, necessary storage capacity of a memory for storing therein the shedding pattern can be reduced. For example, even if the shedding steps comprise or extend to several thousand picks, it is not necessary to store the repeating shedding patterns as a whole, thereby leading to a drastic saving of the storage capacity. Further, when the shedding curve is set, it is switched at the maximum shedding position, namely, at a position where the heddle frame always dwells, and hence it can be freely set without being restricted by the constituents constituting the shedding operation such as upper and lower dwell angles. Accordingly, when the shedding curve is switched in the shedding steps to weave changing the warp tension at the beating time, it is possible to weave a fabric by changing the beating force of the weft.

Further, if the shedding curve compensates for the constituents influencing the shedding operation such as the number of revolutions of the loom and delayed constituents such as a change of the warp tension, the shedding apparatus is driven by selecting the shedding curve compensating for the delayed constituents of the shedding operation in response to the result of comparison of the delayed constituents with respect to an actual measured value, thereby preventing the loom from being stopped due to the delay of the shedding operation, thereby improving the availability of the loom.

Still further, if a suitable shedding curve for weaving fabrics is selected corresponding to the operating state of the loom and availability information, an ideal shedding operation can be realized and the storage capacities of the shedding patterns can be saved.

BRIEF DESCRIPTION OF THE DRAWINGS

FIG. 18 is a still another table showing the relation between upward and downward movements of heddle frames and shedding curves for every shedding step with respect to each heddle frame;

FIG. 22 is a table showing the relation between upward and downward movements of heddle frames and shedding curves for every shedding step with respect to each heddle frame.

PREFERRED EMBODIMENT OF THE INVENTION

Figure 1:
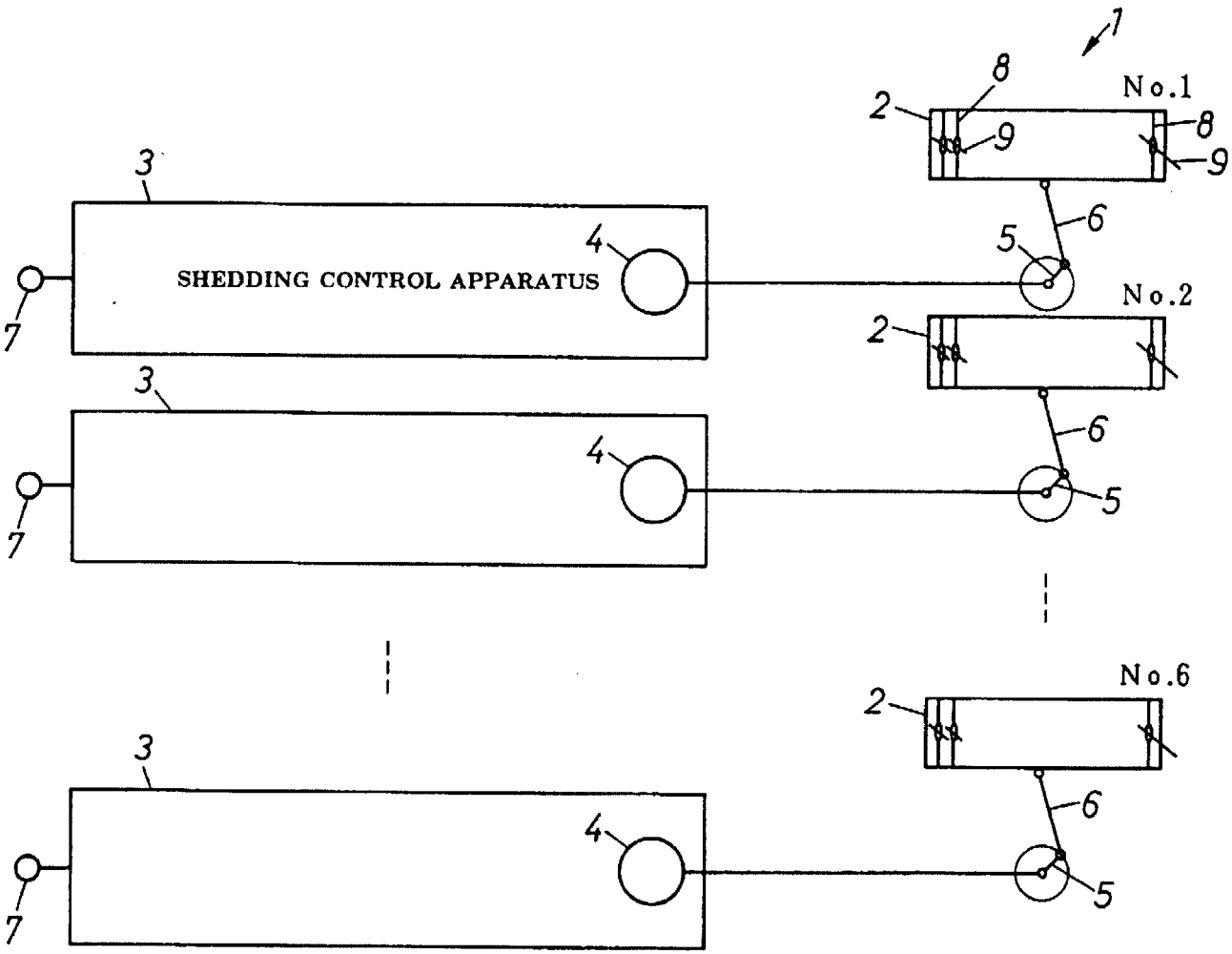
FIG. 1 is a block diagram of an electric shedding apparatus.

FIG. 1 shows a schematic view of an electric shedding apparatus 1. The electric shedding apparatus 1 has shedding control apparatuses 3 and heddle frames 2, e.g., six frames (No. 1, 2, . . . 6). Each shedding control apparatus 3 controls the speed of rotation of a driving motor 4 based on a shedding pattern synchronized with a main shaft 7 of a loom, thereby rotating a shedding operation crank 5 to apply vertical or up/down movement to the heddle frame 2 by way of a connection rod 6, so that the shedding operation is given to a plurality of warps 9 by way of heddles 8 attached to the heddle frame 2.

Figure 2:
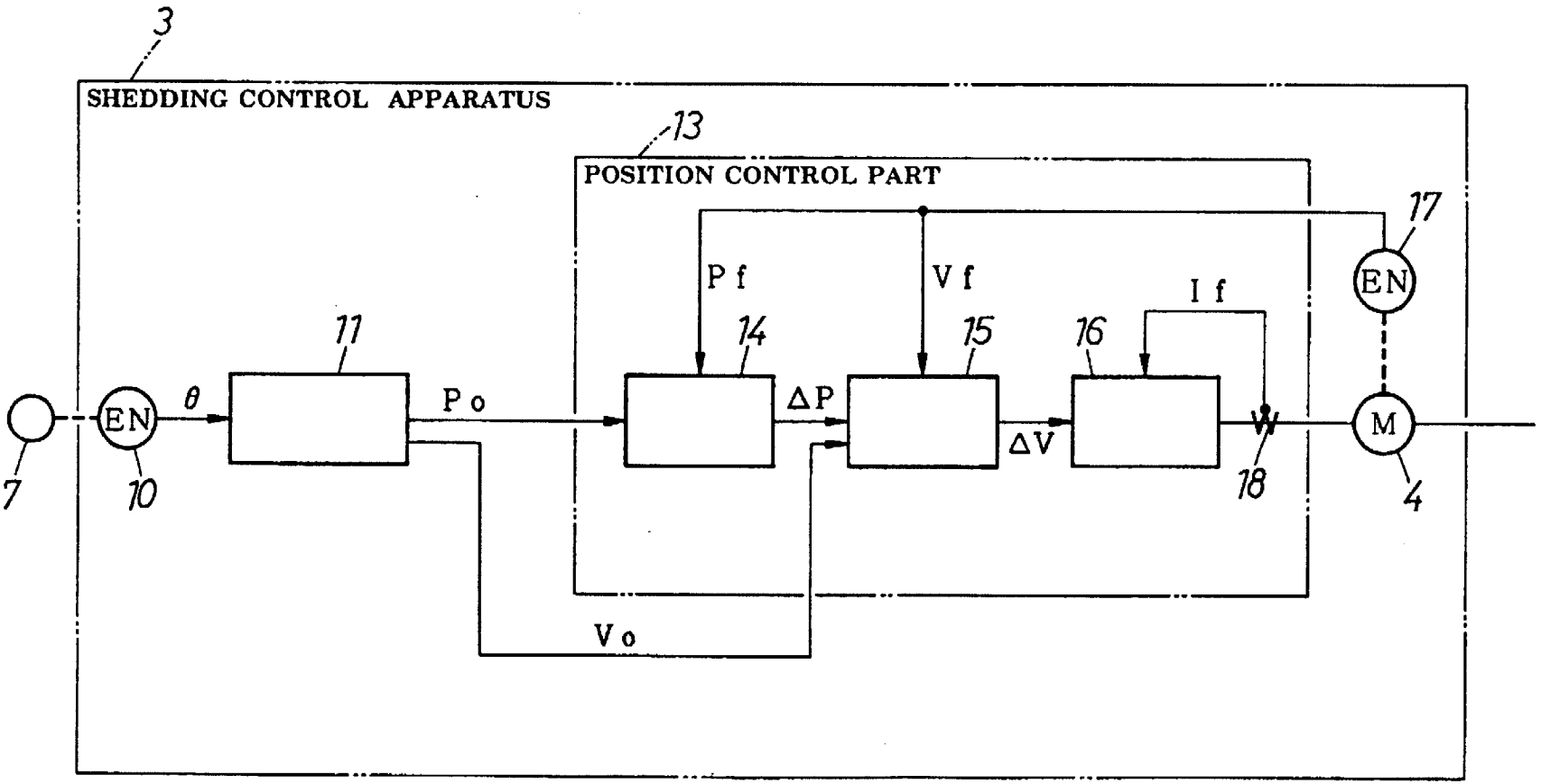
FIG. 2 is a block diagram of a shedding control apparatus.

FIG. 2 shows particular arrangement of the shedding control apparatus 3. A rotation detector 10 detects a rotation angle θ of the main shaft 7 to generate a signal representing the rotation angle θ which is supplied to a position instruction part 11. The position instruction part 11 supplies an instruction or signal of a target revolution Po of the driving motor 4, which is determined in advance in response to the rotation angle θ, to the position control part 13. The position instruction part 11 also supplies a signal representing a base speed Vo, that is the speed of rotation of the driving motor 4, to a speed control circuit 15 inside a position control part 13. The position control part 13 comprises a deviation detection circuit 14, the speed control circuit 15, a current control circuit 16 and a current detector 18.

The deviation detection circuit 14 compares the signal representing the target revolution Po and a signal representing a feed back revolution Pf issued by a rotation detector 17 connected to the driving motor 4, thereby issuing a signal representing a deviation ΔP of revolution which is supplied to the speed control circuit 15. The speed control circuit 15 receives the signal of the base speed Vo and the signal of the feed back revolution Pf from the rotation detector 17 as well as the deviation ΔP and calculates a speed instruction value based on the deviation ΔP and the base speed Vo, and also calculate a speed of rotation of the driving motor 4 based on the feed back revolution Pf, to thereby issue a signal representing a speed deviation ΔV between the thus calculated speed instruction value and the speed of rotation, which signal is supplied to the current control circuit 16.

The current detector 18 detects a current If of the current control circuit 16. The current control circuit 16 controls current to be applied to the driving motor 4 based on the speed deviation ΔV and the current If detected by the current detector 18. Thus, the position control part 13 controls the rotation of the driving motor 4 based on the base speed Vo in response to the target revolution Po.

Figure 3:
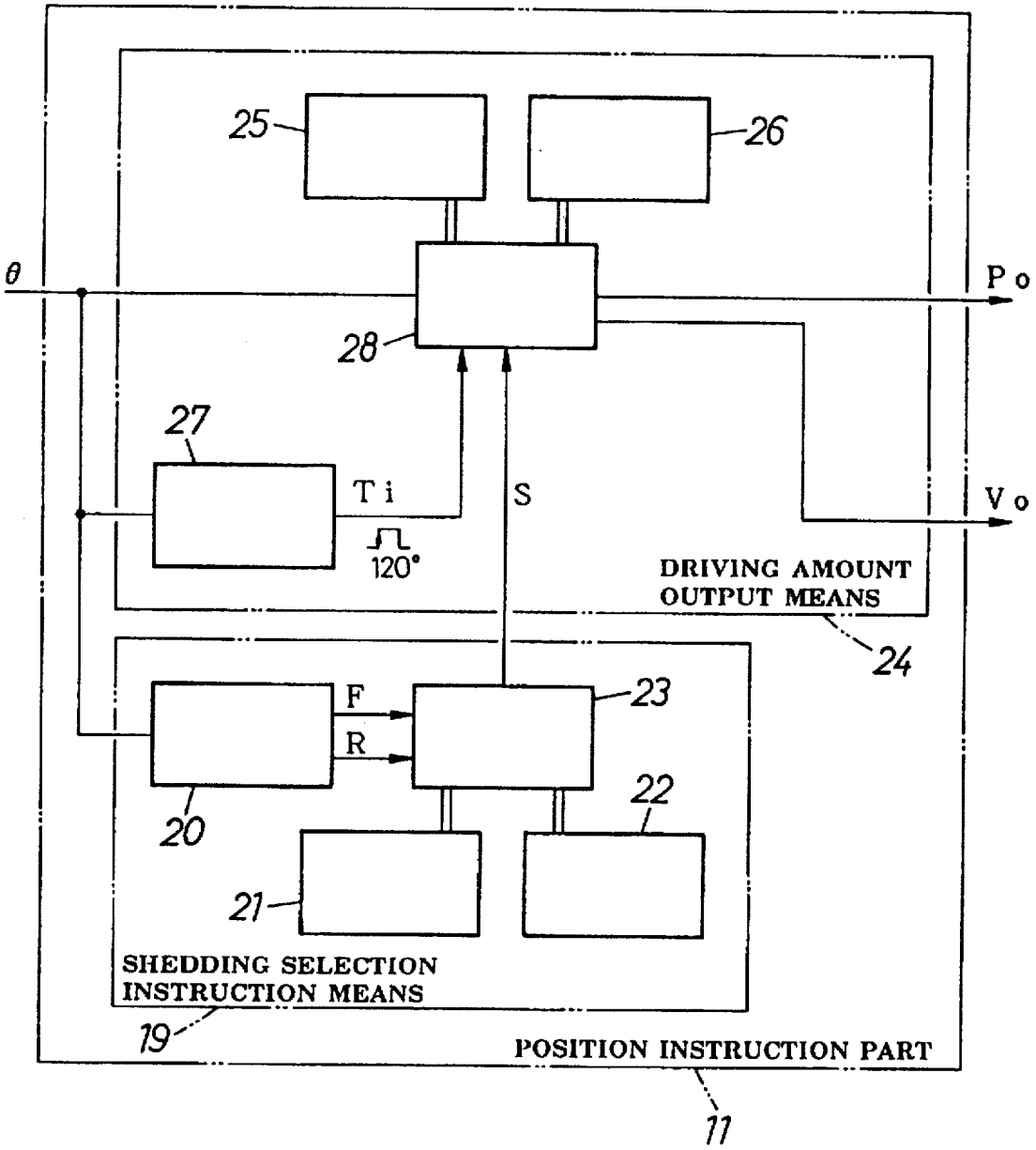
FIG. 3 is a block diagram of a shedding pattern instruction part.

FIG. 3 shows an arrangement of the position instruction part 11. Explained in this embodiment is a case for determining each driving unit of the heddle frame 2 according to moving directions, preparing shedding curves for every one movement of the heddle frame 2 (more specifically, including dwelling, movement, dwelling for down →up movement), selecting suitable shedding curves for each shedding step, outputting a shedding amount instruction of the heddle frame 2 corresponding to the rotation of the main shaft 7, thereby driving the heddle frame 2.

The position instruction part 11 comprises a shedding selection instruction means 19 for outputting a shedding selection instruction S based on the rotation angle θ of the main shaft 7, and a driving amount output means 24 for storing a plurality of shedding curves for every one shedding step corresponding to the rotation angle θ of the main shaft 7 to be set and selectively switching and outputting the target revolution Po and the base speed Vo respectively of the driving motor 4 based on the plurality of stored shedding curves.

The shedding selection instruction means 19 comprises a stepping signal generator 20 for issuing a stepping pulse F and a reverse stepping pulse R at a predetermined angle of the main shaft based on the rotation angle θ of the main shaft 7, a setting device 21 for setting selection instruction data for every shedding step by one repeat, a memory 22 for storing therein the set selection instruction data, and a selection controller 23 for reading the selection instruction data from the memory 22 in response to the stepping pulse F and the reverse stepping pulse R to thereby issue the shedding selection instruction S.

The driving amount output means 24 comprises a setting device 25 for setting constituents constituting the shedding operation, preparing shedding curves by one shedding step based on the constituents, and outputting target phase curves of the driving motor 4 based on the shedding curves, a memory 26 for storing therein the set constituents, a timing signal generator 27 for issuing a shedding switching timing Ti based on the rotation angle θ, and a switching controller 28 for reading the target phase curves in response to the shedding selection instruction S issued by the shedding selection instruction means 19, switching to the read target phase curve in response to the shedding switching timing Ti, and outputting the instruction of the target revolution Po and the signal of the base speed Vo of the driving motor 4 based on the target phase curves corresponding to the revolution of the main shaft 7.

The shedding switching timing Ti is set in advance to be outputted at the main shaft angle where the heddle frame 2 becomes the maximum shedding amount. The shedding curves prepared by the setting device 25 are prepared according to a moving direction as a shedding pattern by one shedding step starting at the shedding switching timing Ti.

Figure 4:
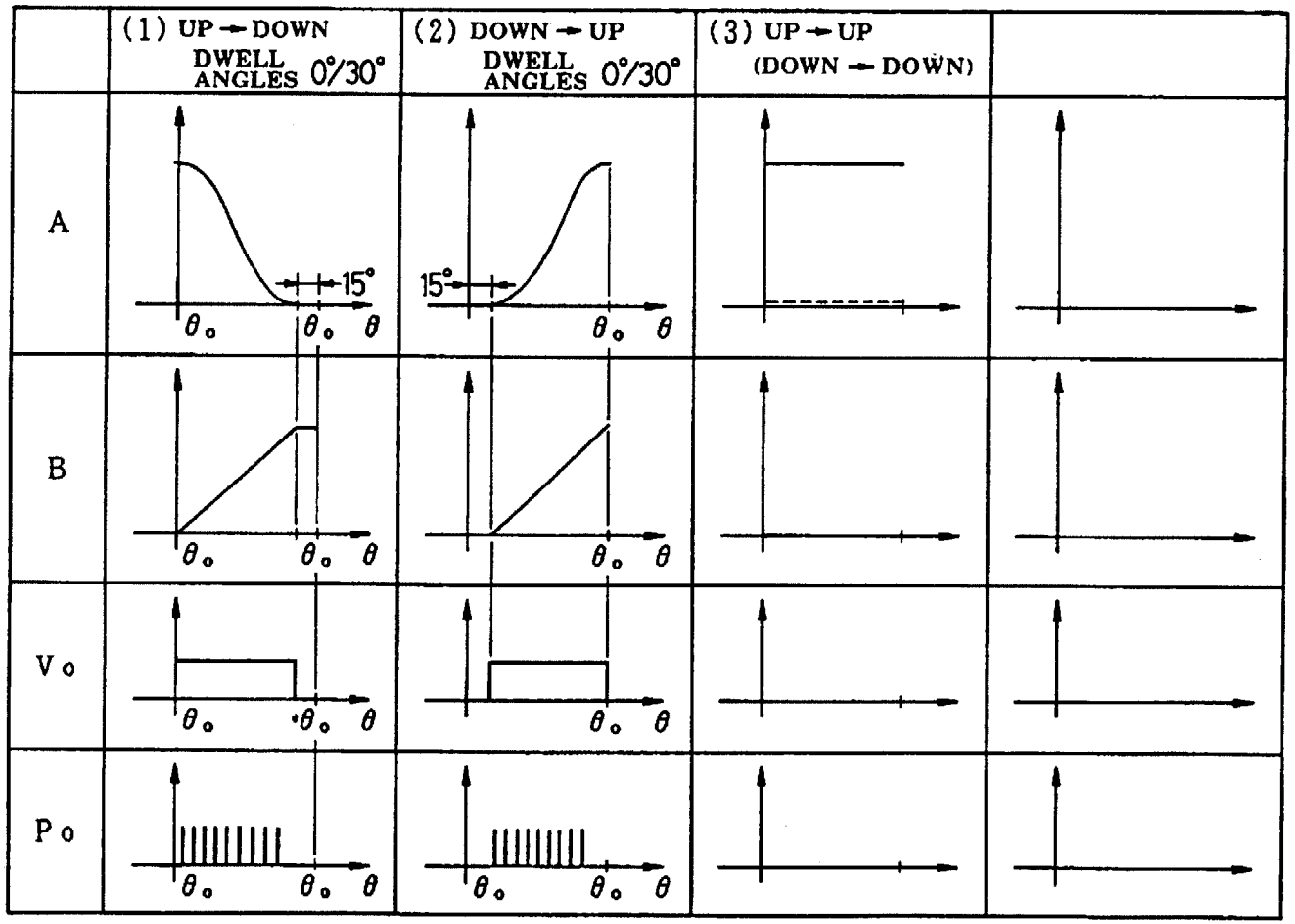
FIG. 4 is a view explaining shedding patterns (shedding curves, target phase curves, base speeds, revolution pulses)

The setting device 25 sets the constituents constituting the shedding operation. The constituents comprise a main shaft rotation angle for switching the shedding curves, i.e., the shedding switching timing Ti, a dwell angle at the maximum shedding position of the upper shed, i.e., upper dwell angle, a dwell angle at the maximum shedding position of the lower shed, i.e., lower dwell angle. When these constituents are set, the setting device 25 for preparing the shedding curves, for example, those denoted by (1), (2) and (3) as the shedding curves A according to the moving directions of the heddle frame 2 as shown in FIG. 4 based on a first algorithm (function) which is previously determined. The shedding curve (1) corresponds to up →down, the shedding curve (2) corresponds to down →up, and the shedding curve (3) corresponds to up →up in solid line or down →down in broken lines (not moving).

For example, since a crank-slider mechanism (the crank 5, the connection rod 6 and the heddle frame 2) is interposed in the operation transmission passage according to the preferred embodiment, each of the shedding curves A of the heddle frame 2 becomes a curve which is small in acceleration in the rising or lowering position (gentle curve). In addition to the constituents set forth above, when the shedding curves are prepared, it is also possible to set a cross point, i.e., the rotation angle of the main shaft where the warps are in a shedding state, or to set the main shaft rotation angles and shedding amounts as a plurality of intermediate point data between the cross point and the next cross point, thereby preparing the shedding curves by connecting these points by a straight line. As a result, the shedding curves can be more simply prepared without using complex functions.

Successively, the setting device 25 prepares the target phase curves of the driving motor 4 wherein the target phase curves correspond to the prepared shedding curves. The thus prepared target phase curves are stored in the memory 26 in advance together with specified numbers of the shedding curves by way of the switching controller 28. Each target phase curve is prepared in accordance with a second algorithm (function) according to an operation mechanism for driving the heddle frame 2. For example, since the crank-slider mechanism (the crank 5, the connection rod 6 and the heddle frame 2) is interposed in the operation transmission passage, even if the shedding curves A of the heddle frame 2 are set to curves which are small in acceleration in the rising or lowering position (gentle curves), the target phase curves B are prepared to be varied substantially linearly.

$\theta_0$ in FIG. 4 corresponds to the shedding switching timing Ti when the target phase curves B are switched. Dwell angles in FIG. 4 represent the main shaft rotation angles where the main shaft dwells or stands still at the maximum shedding position. The dwell angles of 0°/30° represent 0° at the upper dwell angle and 30° at the lower dwell angle. Since the starting points of the shedding curves A for one shedding step are the main shaft angle where the heddle frame 2 sheds at the maximum, the shedding curve (1) is prepared in such a manner that it starts lowering at the $\theta_0$ of the main shaft angle, ends lowering at $\theta_0$−15° of the main shaft angle and dwells until next $\theta_0$.

The target phase curves B are prepared in such a manner that they increase linearly from $\theta_0$ of the main shaft angle to $\theta_0$−15° of the next cycle of the main shaft angle, then they remain until the next $\theta_0$ of the main shaft angle. Thereafter, the target phase curves B corresponding to the shedding curves (2) and (3) are also prepared in the aforementioned manner. In the preferred embodiment, since the driving motor 4 is rotated in the same direction with respect to the moving direction of the heddle frame 2, i.e., up →down and down →up directions, the target phase curves B increase rightward both in the shedding curves (1) and (2) but they can be prepared to decrease rightward when the driving motor 4 is rotated reversely depending on the moving direction. As mentioned above, the target phase curves B are prepared based on the shedding curves A, and an advance processing (preparation) for calculating the target revolution Po under the base speed Vo is carried out.

The shedding instruction reading timings are set in the setting device 21 and the shedding instructions (up/down) are set for every shedding step. Upon completion of the settings, the setting device 21 compares the shedding instruction (up/down) of the previous step with that of the present step, automatically selects the number of the shedding curve corresponding to the present step among the shedding curves (1), (2) and (3), then stores the selected number of the shedding curve in the memory 22 by way of the selection controller 23. Accordingly, the memory 22 sequentially stores either of the shedding curves (1), (2) and (3) together with the moving direction of the heddle frame 2, namely, lowering "0" and rising "1" extending to one repeat shedding step Sp 1, 2 . . . 6 of one repeat for every number of the heddle frame 2 (No.).

When the shedding curves and the shedding selection instructions S are set to complete the preparation, the loom is ready to be operated. Since the shedding steps are stored in the selection controller 23, when the preparation is completed, the selection controller 23 sets the shedding step Sp to "1", and reads the moving direction of the heddle frame 2, i.e., a specified number of the shedding curve corresponding to the shedding step Sp from the memory 22, thereby outputting the shedding selection instruction S. Thereafter, when the loom rotates, the stepping signal generator 20 outputs the stepping pulse F or the reverse stepping pulse R in a predetermined rotation angle in response to the rotating direction of the loom.

Every time the stepping pulse F or the reverse stepping pulse R is inputted into the selection controller 23, the selection controller 23 adds "1" to or subtracts "1" from the stored shedding steps Sp, reads the moving direction of the heddle frame 2, i.e., the specified numbers of the shedding curves corresponding to the shedding step Sp from the memory 22, thereby outputting the shedding selection instruction S. Thereafter, every time the stepping pulse F or the reverse stepping pulse R is inputted when the loom is rotated, the shedding selection instruction S corresponding to each shedding step is sequentially outputted. Meanwhile, when the shedding step is further subtracted by "1" serving as a leading step, it is automatically set to a last step "n" while when the shedding step is further added by "1" serving as the last step "n", it is automatically set to the leading step "1".

On the other hand, in the driving amount output means 24, when the shedding selection instruction S is inputted into the switching controller 28, the switching controller 28 reads the target phase curve corresponding to the shedding selection instruction S, namely, the specified number of the shedding curve. The switching controller 28 calculates the target revolution Po and the base speed Vo based on the read target phase curve in response to the rotation angle θ of the main shaft 7 to be inputted, thereby outputting the signals of the thus calculated target revolution Po and the base speed Vo.

Thereafter, when the loom is rotated to output the shedding selection instruction S corresponding to the next shedding step from the selection controller 23, the switching controller 28 reads from the memory 26 the target phase curve in response to the shedding selection instruction S. When the shedding switching timing Ti is outputted from the timing signal generator 27, the switching controller 28 switches the target phase curves to the thus read target phase curve to thereby output the instruction of the target revolution Po and the signal of the base speed Vo corresponding to the rotation angle θ based on the target phase curves shown in FIG. 4. The target revolution Po which is determined by the target phase curve owing to the rotation angle θ of the main shaft 7 is outputted as a pulse signal, and the base speed Vo is calculated and outputted as a signal based on the rotation speed of the main shaft 7 which is determined by the change of the rotation angle θ.

Subsequently, the instruction of the target revolution Po is supplied to the position control part 13, and the position control part 13 carries out a positional control to permit the driving motor 4 to follow the target revolution Po. The base speed Vo is outputted from the position instruction part 11 to the speed control circuit 15 so as to permit the driving motor 4 to follow the target revolution Po more quickly when the deviation ΔP is generated. According to the present embodiment, the switching controller 28 reads the target phase curve of the next shedding cycle and changes the read target phase curve to the target phase curve which was read during passing through the shedding switching timing Ti upon completion of the present shedding cycle. This is caused in order to ensure that the reading of the target phase curve before the next shedding cycle starts even if it takes time to read the target phase curve.

If the target phase curve is quickly read, the target phase curves may be switched when the shedding selection instruction S is outputted to complete the reading of the target phase curve without providing the timing signal generator 27. It is preferable to set the upper and lower dwell angles to prevent the deviation of the phases owing to the accumulation of the shortage of the output of the revolution, which occurs when the target phase curve is switched before the instruction of the target revolution Po is completely outputted from the switching controller 28.

The practical operation for weaving a twill texture (2/1) will be described next. Explained here are the constituents for constituting shedding curves for one cycle of the loom (one revolution of the main shaft), i.e. by the shedding step, namely, the shedding switching timing Ti, and the single shedding curve not changing the upper and lower dwell angles.

For example, inputted into the setting device 25 are the shedding switching timing Ti which is 120°, the upper dwell angle which is 0° and the lower dwell angle which is 30° whereby the shedding curves and the target phase curves are prepared as shown in FIG. 4, which are stored in the memory 26 and selectively set therein. On the other hand, the specified numbers of the shedding curves, of one repeat, i.e. three shedding steps are set and stored in the setting device 21 of the shedding selection instruction means 19, while the stepping pulse F and the reverse stepping pulse R are set respectively to 110° and 130° in advance and stored in the stepping signal generator 20.

Figure 6:
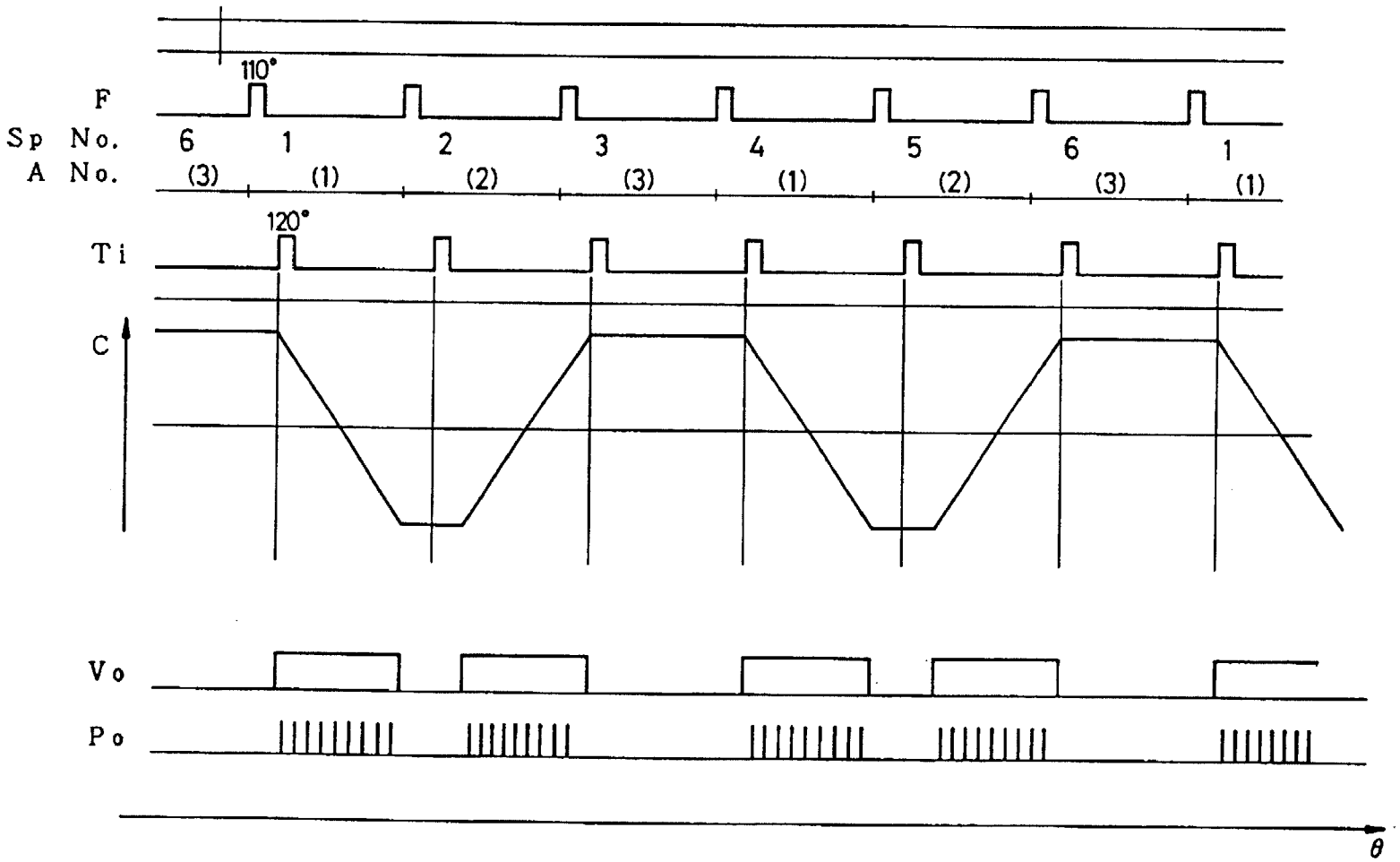
FIG. 6 is a view showing shedding operations of one heddle frame.

FIG. 6 shows the stepping pulses F (110°) for reading the selected shedding curves in the normal rotation direction, the specified numbers (1), (2) and (3) of the shedding curves A, the shedding switching timing Ti (120°), the shedding amount C, the signals of the base speed Vo and the target revolution Po which respectively correspond to the numbers of the shedding steps Sp of the No. 1 heddle frame 2 and appear on the axis of rotation angle θ of the main shaft 7.

The position instruction part 11 sequentially selects the target phase curves which are stored in advance for every shedding switching timing Ti corresponding to the rotation angle θ of the main shaft 7 according to the shedding curves (1), (2) and (3), so that the driving motor 4 is driven by the predetermined revolution Po to thereby give predetermined shedding patterns to the corresponding heddle frames 2.

Figure 7:
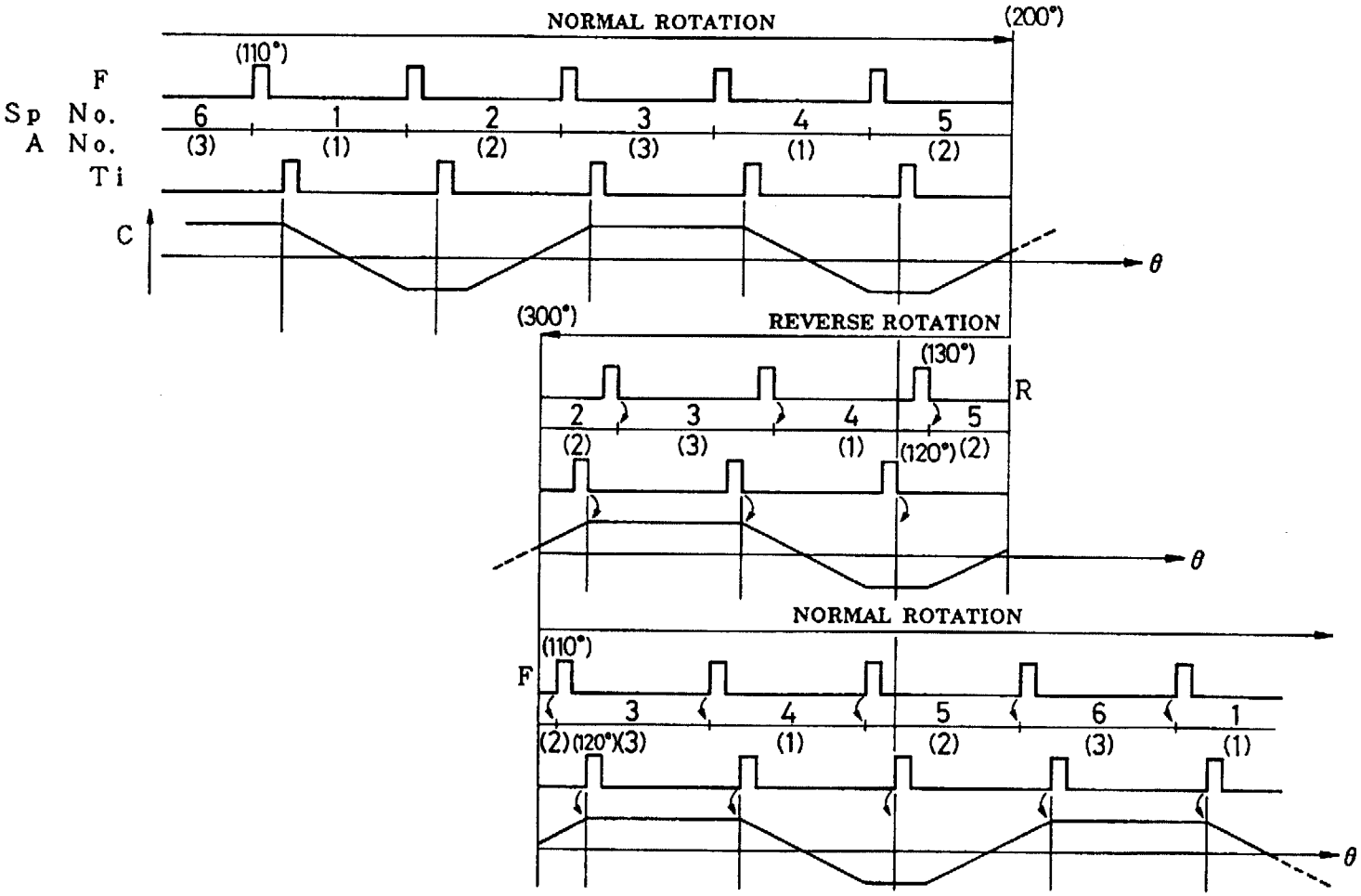
FIG. 7 is a view showing the shedding operations of one heddle frame at normal, inching and reverse rotations of a main shaft.

FIG. 7 shows a case for controlling the No. 1 heddle frame 2 based on the reverse stepping pulses R (130°) for reading the selected shedding curves in the reverse rotation after the normal rotation is stopped. In FIG. 7, the loom rotates normally in the order of the steps Sp of 6→1→2→3→4→5, and stops at 200° in the shedding step 5, then reversely rotates in the order of the shedding steps Sp of 5→4→3→2, and stops at 300° in the shedding step 2, and then it normally rotates sequentially in the order of the steps Sp of 2→3→4→5→6.

That is, even if the rotating direction of the main shaft 7 is changed from the normal rotation to the reverse rotation at the shedding step 5, the stepping pulse generator 20 issues the reverse stepping pulse R at 130° which is ahead of the shedding switching timing Ti, and the selection controller 23, upon reception of this reverse stepping pulse R, subtracts the shedding steps by "1" and reads the target phase curve of the previous shedding step 4, then the switching controller 28 switches the target phase curves to the thus read target phase curve at the shedding switching timing 120°, thereby sequentially driving the electric shedding apparatus 1.

Further, even if the rotating direction of the main shaft 7 is switched from the reverse rotation to the normal rotation in the shedding step 2, the next target phase curve is read before reaching the shedding switching timing Ti in the same manner as the reverse rotation, thereby sequentially driving the electric shedding apparatus 1. Thus, the electric shedding apparatus 1 can be driven while following the rotation of the main shaft 7 in the same manner as made conventionally.

The switching of the shedding curves may be carried out at the maximum shedding position because of the following reason. That is, if the angles of the main shaft are differentiated between the shedding curves to be selected during one repeating pattern due to the setting of the upper and lower dwell angles at the position where the heddle frame 2 closes (cross point), the shedding curves do not continue, whereby positioning control can not be performed, and since the target revolution remains outputted before or after the cross point, the shortage of the output of the signal of the target revolution Po which occurs when the target phase curves are switched accumulates, leading to the occurrence of deviation of the phases.

Accordingly, if the shedding curves are switched within the range of the dwell angles of the rotation angle of the main shaft where the heddle frame 2 sheds at the maximum, the aforementioned drawbacks do not occur, and the shedding curves can be freely set without being restricted by the constituents constituting the shedding operation such as the upper and lower dwell angles. Accordingly, it is possible to weave changing the warp tension at the beating time by switching the shedding curves in response to the shedding step or a beating force of the weft is changed to weave the fabric, thereby improving the weaving performance.

Figure 8:
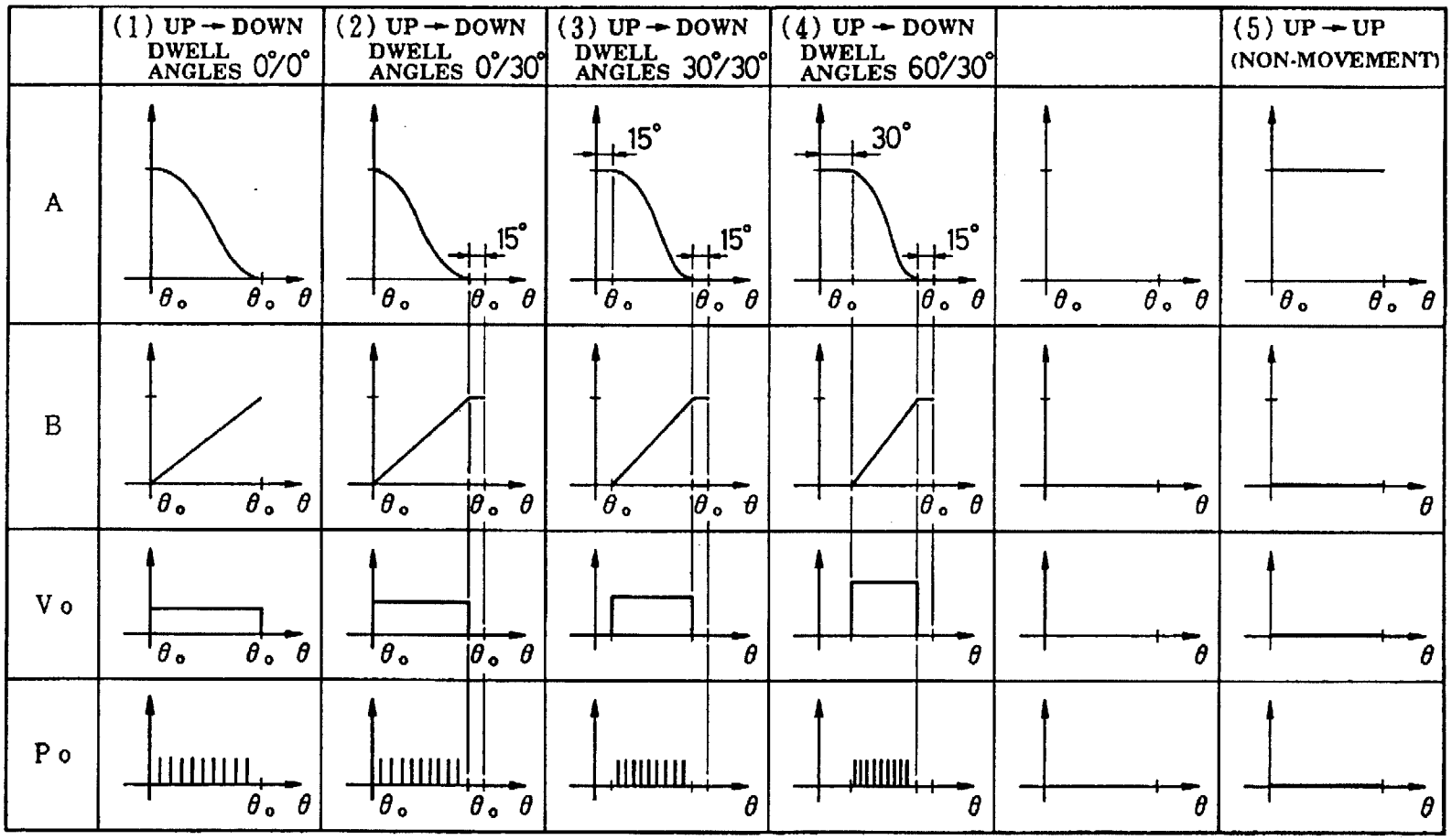
FIG. 8 is a view explaining other shedding patterns (shedding curves, target phase curves, base speeds, revolution phases)
Figure 9:
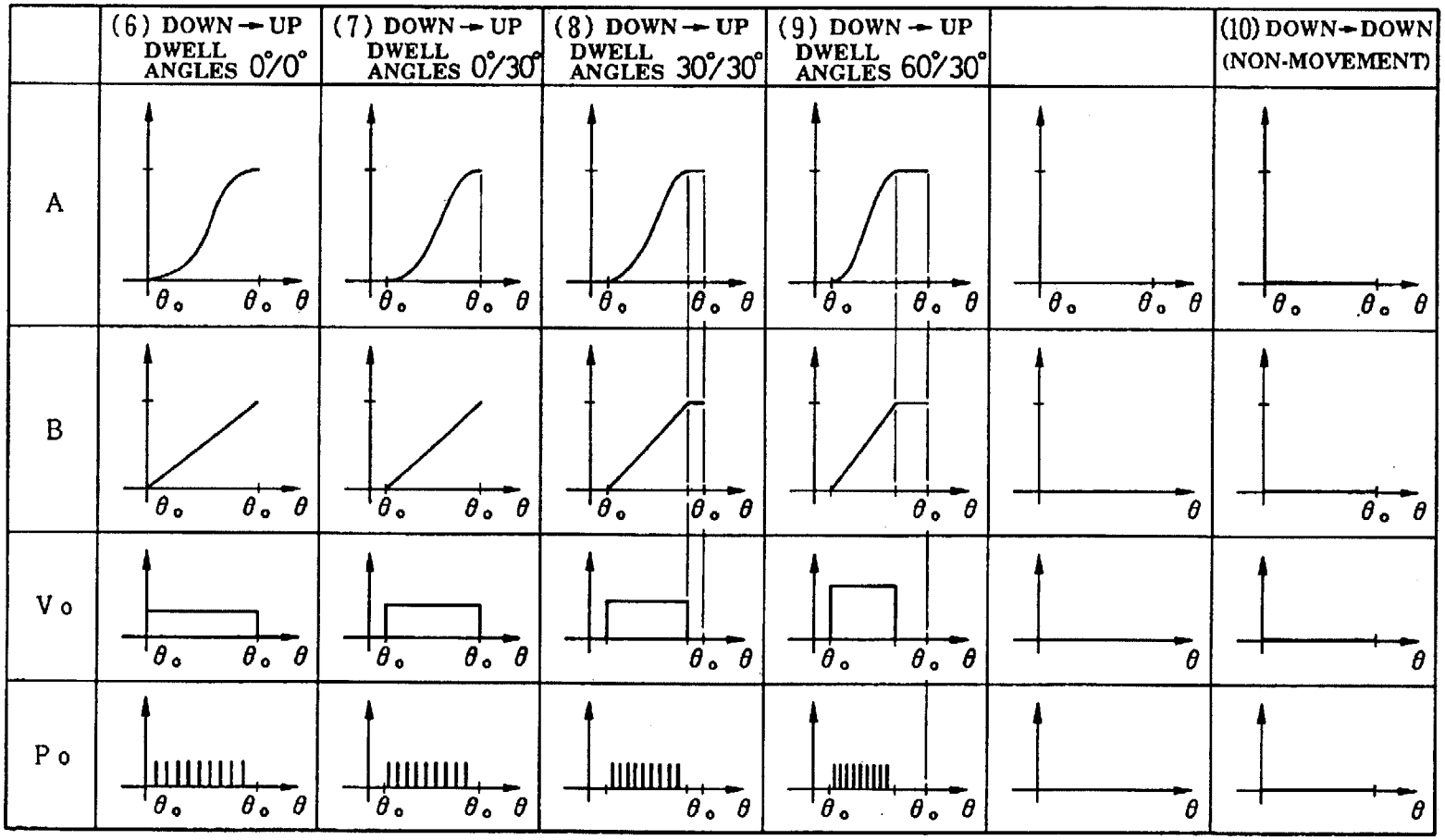
FIG. 9 is a view explaining still other shedding patterns (shedding curves, target phase curves, base speeds, revolution phases)

Explained next is a case in which the present invention is applied, where one shedding curve is selected from the plurality of shedding curves in the shedding steps. Necessary numbers of the shedding curves (1), (2), (3), (4), (5), (6), (7), (8), (9) and (10) of the shedding curves A are set in advance in the setting device 25 as shown in FIGS. 8 and 9. These shedding curves (1) to (10) are respectively prepared according to the moving directions of the heddle frames as different constituents (upper dwell angle and lower dwell angle), and these shedding curves are stored in the memory 26 together with the specified numbers of the shedding curves A.

Figure 10:
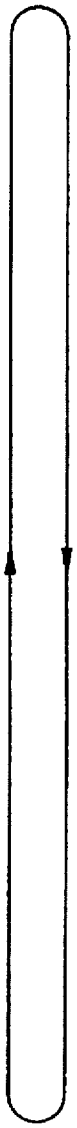
FIG. 10 is another table showing the relation between upward and downward movements of heddle frames and shedding curves for every shedding step with respect to each heddle frame.
Figure 11:
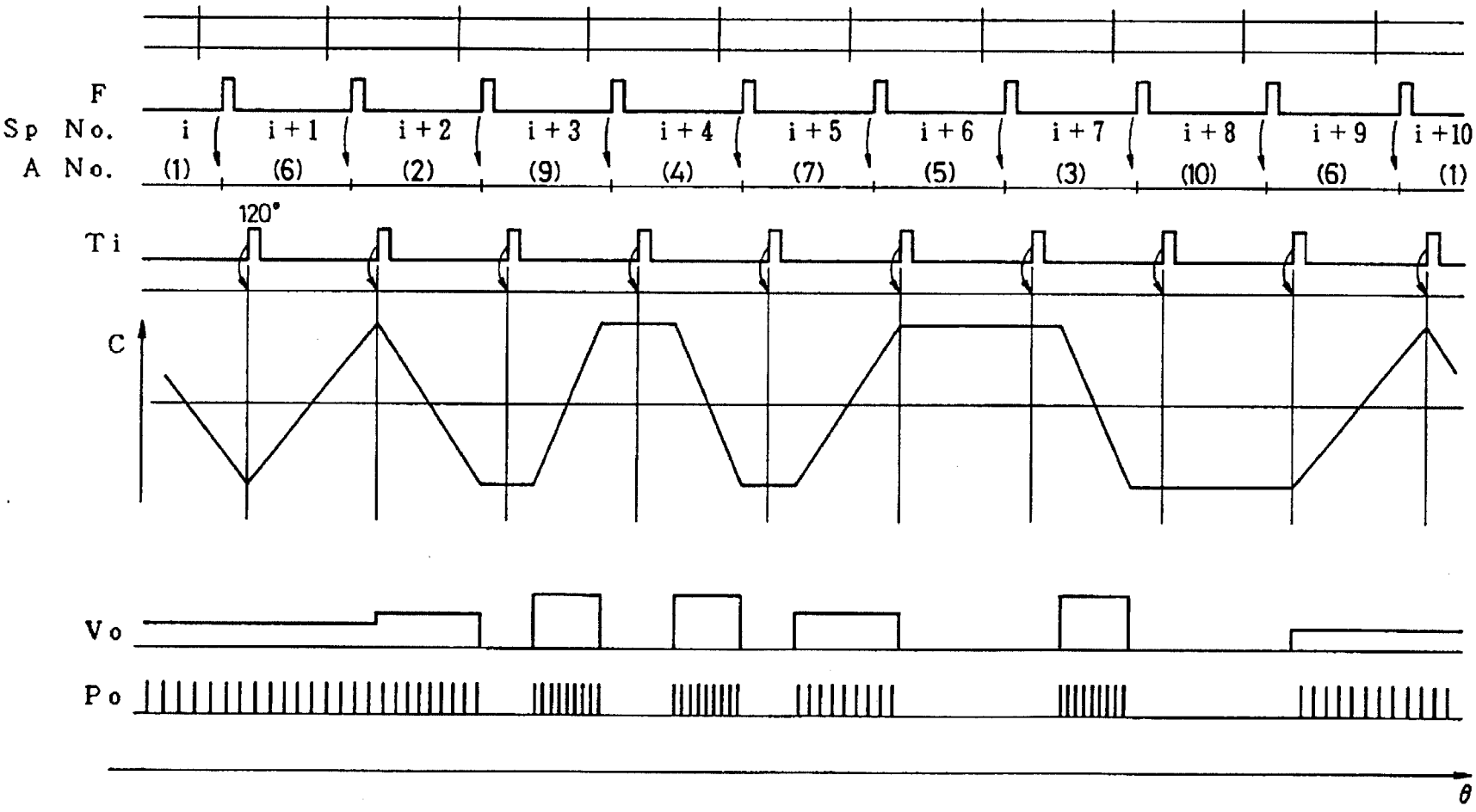
FIG. 11 is a view showing other shedding operations of one heddle frame.

The shedding switching timing Ti, the shedding instructions at each shedding step, and specified numbers of shedding curves to be selected are stored in the setting device 21 for shedding selection. FIG. 10 shows a state of setting of the specified numbers of the shedding curves corresponding to the shedding steps Sp for the shedding operations by the shedding steps Sp, the shedding curves A and the shedding amounts C for the No. 1 heddle frame 2 when the loom operates.

As a modification of the preferred embodiment, it is possible to select a plurality of shedding curves depending on the constituents relating to delay of the shedding operation. Main constituents influencing delay of the shedding operation are the revolution N of the loom and the warp tension Te. Accordingly, the shedding control considering the delay of the shedding operation is carried out based on at least one revolution N of the loom and the warp tension Te. It is needless to say that the constituents include other constituents such as the weight of the heddle frame 2 and inertia of the (shedding) operating parts.

In the shedding control according to this embodiment, a delay time $\alpha$ is set in the setting device 25 in addition to the data set forth in the previous embodiment. When the delay time $\alpha$ is set in the setting device 25, it is converted into the rotation angle $\theta$ of the main shaft 7, thereby preparing the shedding curves based on the rotation angle $\theta$ corresponding to the delay time $\alpha$, and the thus prepared or compensated shedding curves are stored in the memory 22.

For example, the upper dwell angle x and the lower dwell angle y are compensated as follows with respect to the delay time $\alpha$ which is converted into the rotation angle $\theta$ of the main shaft 7.

| Moving Direction | Before Compensation upper dwell angle/ lower dwell angle | After Compensation upper dwell angle/ lower dwell angle |
|---|---|---|
| down → up | x/y | $(x+\alpha)/(y-\alpha)$ |
| up → down | x/y | $(x-\alpha/(y+\alpha)$ |
| up → up (down → down) | x/y | x/y |
| revolution N of the loom | low ← → high | |
| warp tension Te | low ← → high | |

Figure 12:
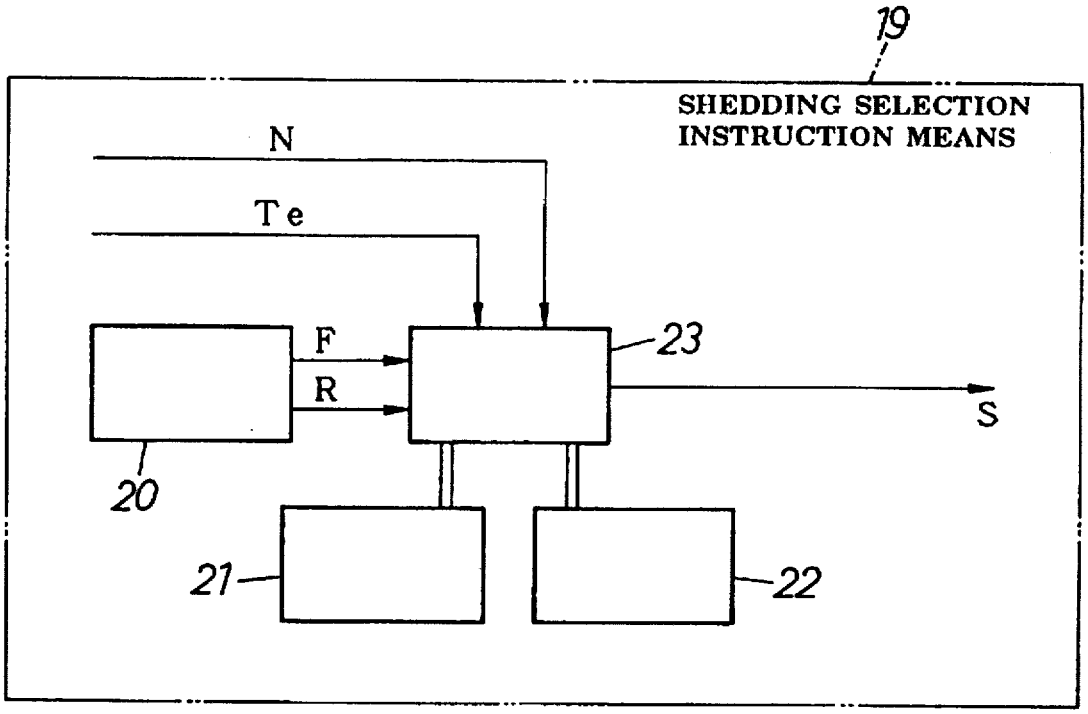
FIG. 12 is a block diagram of a shedding selection instruction means according to another embodiment of the present invention.
Figure 13:
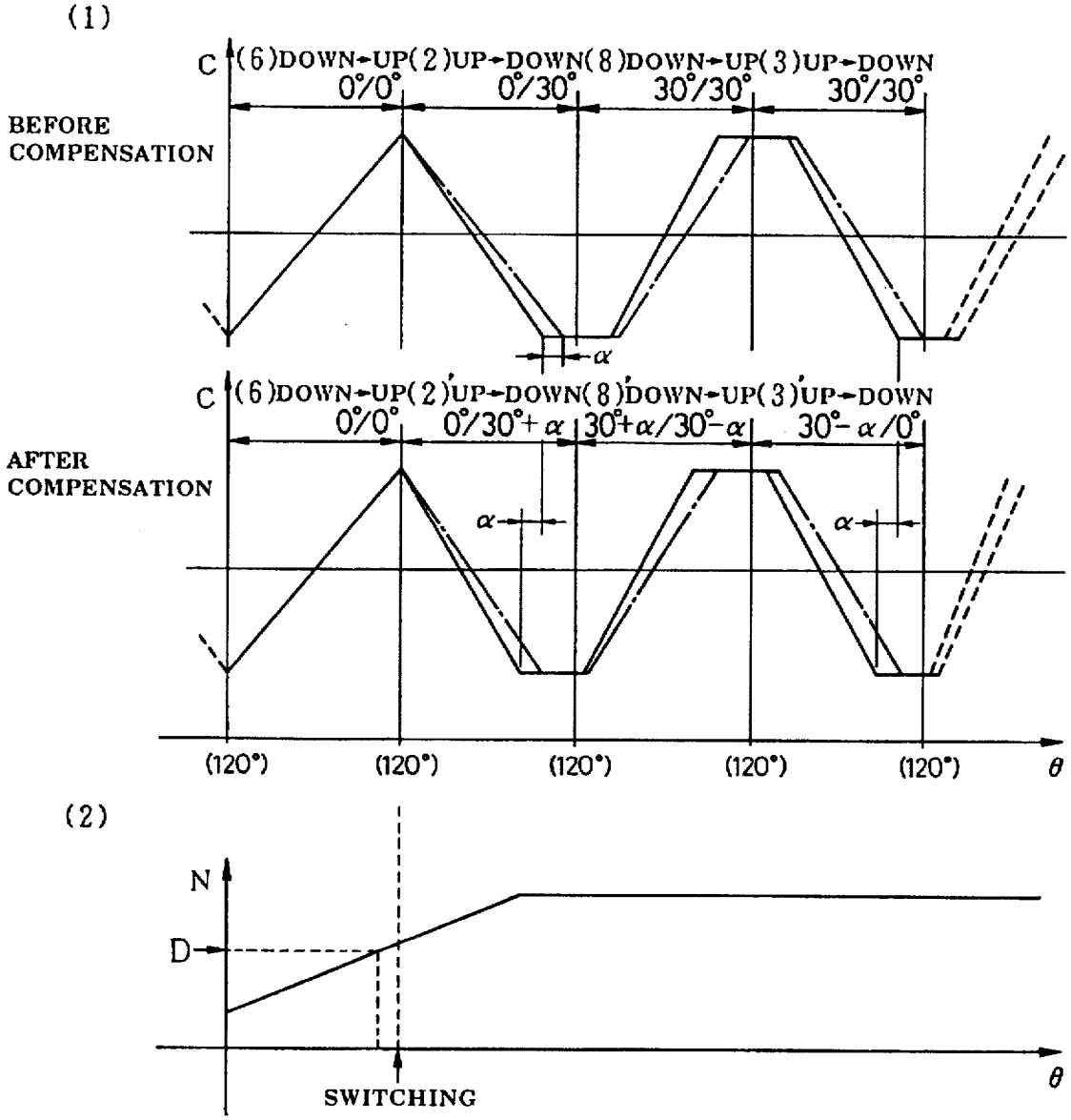
FIG. 13 is a view explaining shedding operations taking into account delayed constituents of the shedding operations with respect to a revolution of a loom.

In this case, as shown in FIG. 12, the selection controller 23 receives the signals representing revolution N of the loom and the warp tension Te and outputs the shedding selection instruction S for selecting the shedding curve corresponding to the delay when both or one of the revolution N of the loom and the warp tension Te exceeds a threshold value D as shown in FIG. 13. Thus, the corresponding heddle frame 2 is driven based on the shedding curves which are selected in response to the revolution N of the loom and the warp tension Te. With such an arrangement, it is possible to prevent the shedding operations from being delayed since the shedding patterns can be prepared in advance considering the constituent of the delay of the revolution N of the loom as exemplified in FIG. 13.

When the revolution N of the loom increases during rotation of the loom so as to exceed the threshold value D for compensating for the delay, it is possible to select the shedding curve which compensates for the delay when the next shedding curve is selected. When the revolution N of the loom exceeds the threshold value D during the selection of the shedding curve (6) in FIG. 13, a shedding curve (2)' which compensates for the delay time $\alpha$ is selected instead of the next shedding curve (2), and the heddle frame 2 is driven based on the selected shedding curve (2)'. Successively, the shedding curves which compensate for the delay time $\alpha$ are selected until the revolution of the loom is less than the threshold value, and the heddle frames 2 are sequentially driven.

Even if the shedding steps extend to several thousand picks and the delay of the shedding operations needs be compensated, it is not necessary to store a plurality of memories for one repeat shedding curve which is compensated for the delay of the shedding operation so that the storage capacity can be reduced or saved, and stop of the loom (e.g. mispicking) owing to the delay of the shedding operations can be prevented, and hence the availability of the loom is enhanced. The delay time $\alpha$, converted into the rotation angle $\theta$, may be independently set according to the moving direction of the heddle frame 2 or the dwell angles to be compensated.

Figure 14:
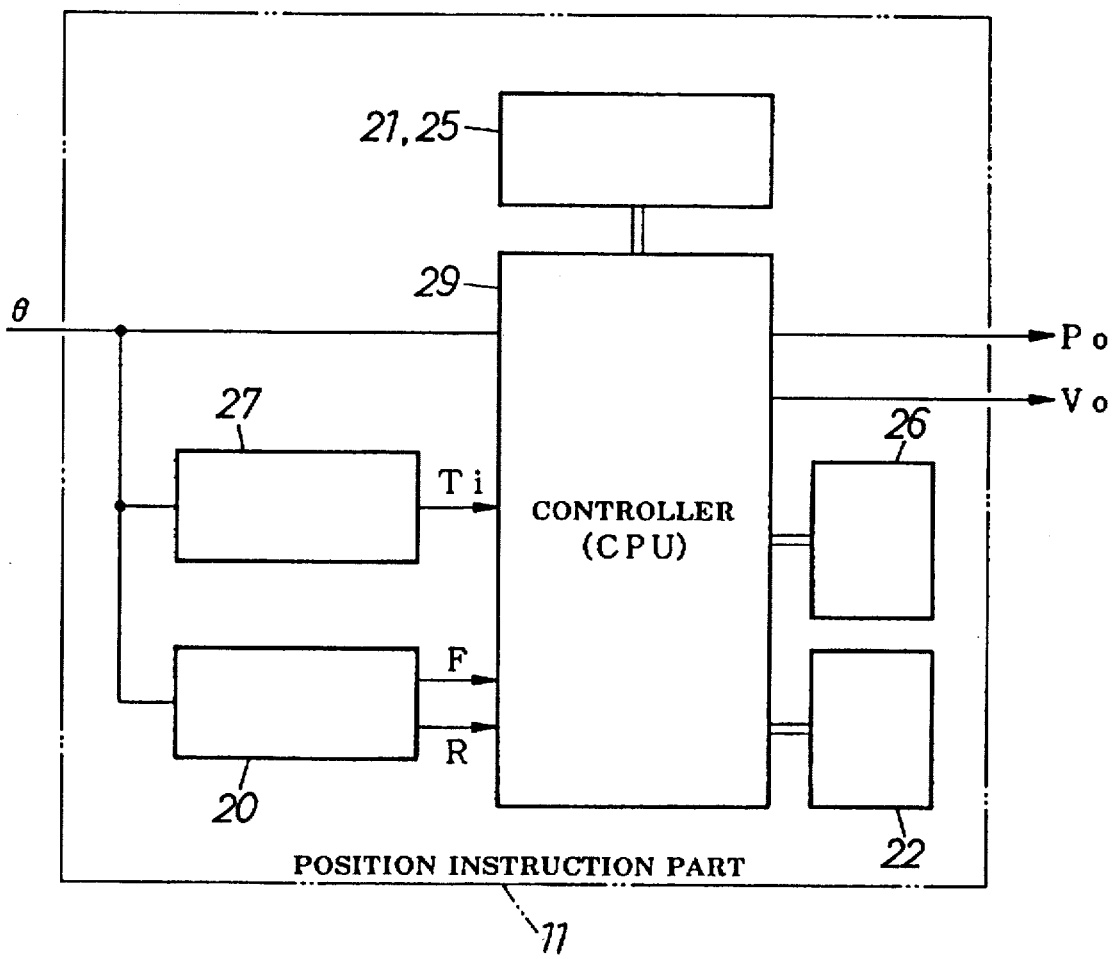
FIG. 14 is a block diagram of a shedding pattern instruction part according to another embodiment.

The arrangements of the shedding selection instruction means 19 and the driving amount output means 24 inside the position instruction part 11 are variously modified. For example, the arrangement of the position instruction part 11 in FIG. 14 shows an example wherein the shedding selection instruction means 19 and the driving amount output means 24 of the preferred embodiment are integrated with each other to form one controller (CPU) 29. The controller 29 is connected to a single setting device (21, 25) which is formed by integrating the setting device 21 and the setting device 25 of the preferred embodiment, the memory 22, the memory 26, the stepping signal generator 20 and the timing signal generator 27. In this modified example, it is possible to carry out the same control as in the previous embodiment.

Figure 15:
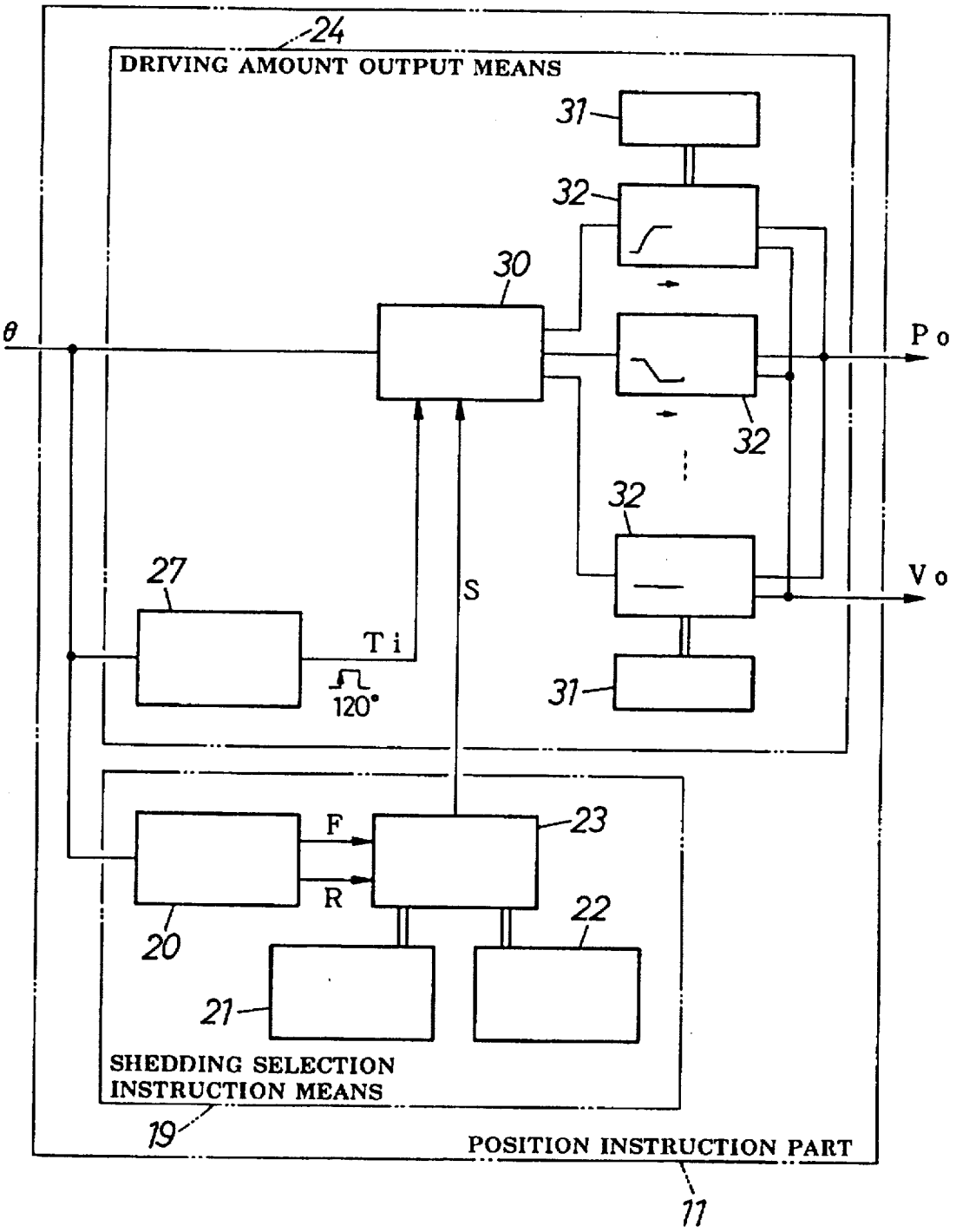
FIG. 15 is a block diagram of a shedding pattern instruction part according to a still another embodiment.

Further, another modified example shown in FIG. 15 includes a switching device 30 in the driving amount output means 24. The switching device 30 is replaced by the switching controller 28 in the previous embodiment, and a plurality of setting devices 31 and memories 32 are connected to one another and arranged in parallel with one another for every shedding curves. The instruction of the target revolution Po and the signal of the base speed Vo are outputted when the setting devices 31 and the memories 32 are suitably selected. As set forth above in the modified examples, it is possible to modify the arrangement variously but the arrangement is not limited to such various modifications.

In the preferred embodiment and the modified examples, each shedding curve is set corresponding to one revolution of the main shaft 7 starting at the angle where the heddle frame 2 dwells at the maximum shedding state, but they are not limited to be set in such a manner.

For example, the starting point of the shedding curve is not limited to the angle where the heddle frame 2 dwells at the maximum shedding state, but it may be the angle of the main shaft 7 where the heddle frame 2 dwells or the angle of the main shaft 7 where the heddle frame 2 closes. Further, the setting intervals of the shedding curves are not limited to the intervals corresponding to one movement of the heddle frame 2, namely, not limited to the intervals from the starting point (the angle of the main shaft at the maximum shedding state) to the end point (the angle of the main shaft at 360° from the starting point), but it may be the interval where the heddle frame 2 moves for the length of M or 1/M, where M is an integer of 2 or more and less than the number of the repeat.

Figure 16:
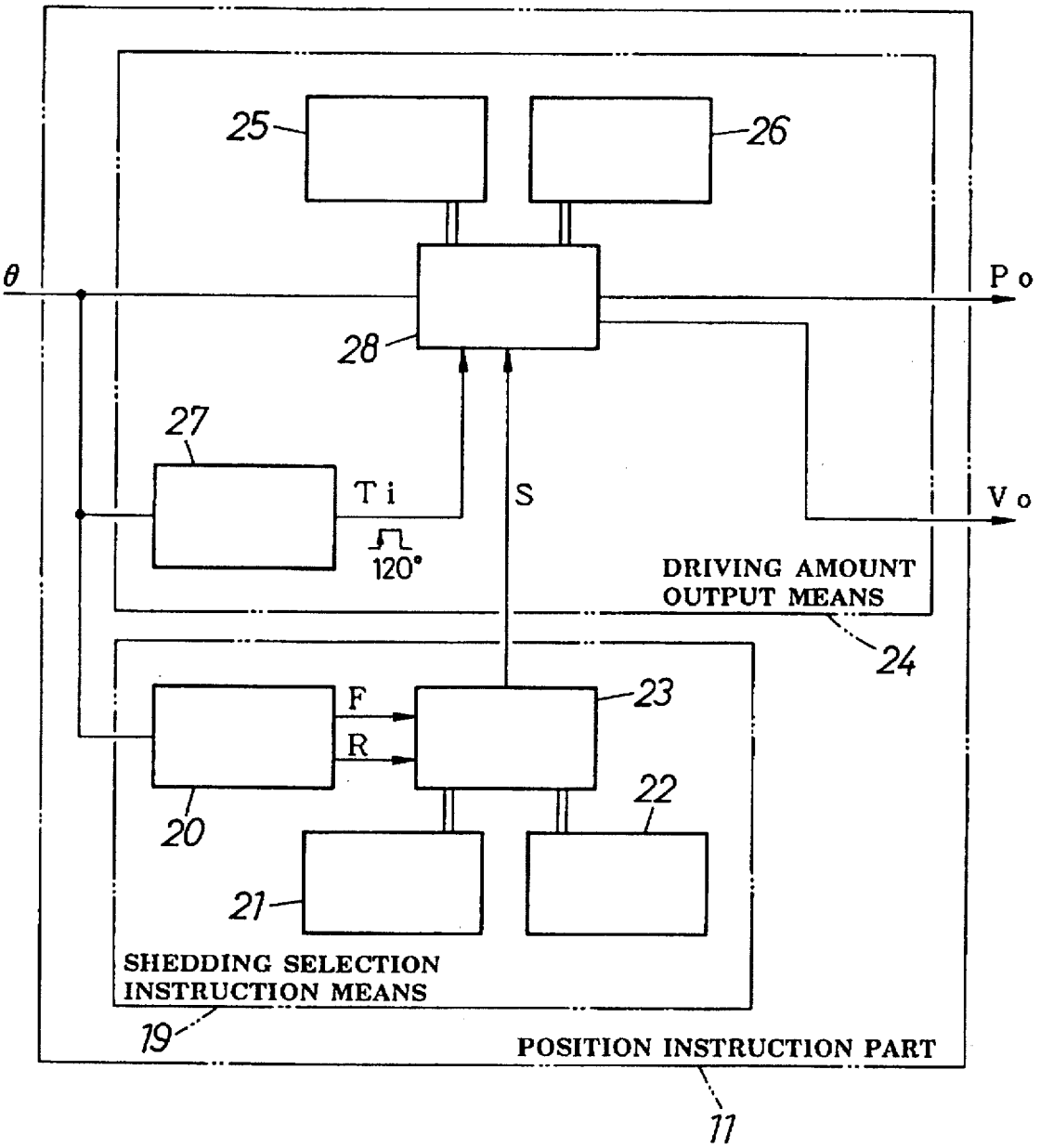
FIG. 16 is a block diagram of a shedding pattern instruction part according to a further embodiment of the present invention.

When the shedding curve is set to be the interval where the heddle frame 2 moves a distance of M, the starting point of the shedding curve becomes the angle of the main shaft 7 at the maximum shedding state and the end point becomes revolutions such as two or three revolutions of the main shaft 7 from the starting point. FIG. 16 shows the position instruction part 11 which is the same as that in FIG. 3, wherein the position instruction part 11 is used as it is.

Figure 17:
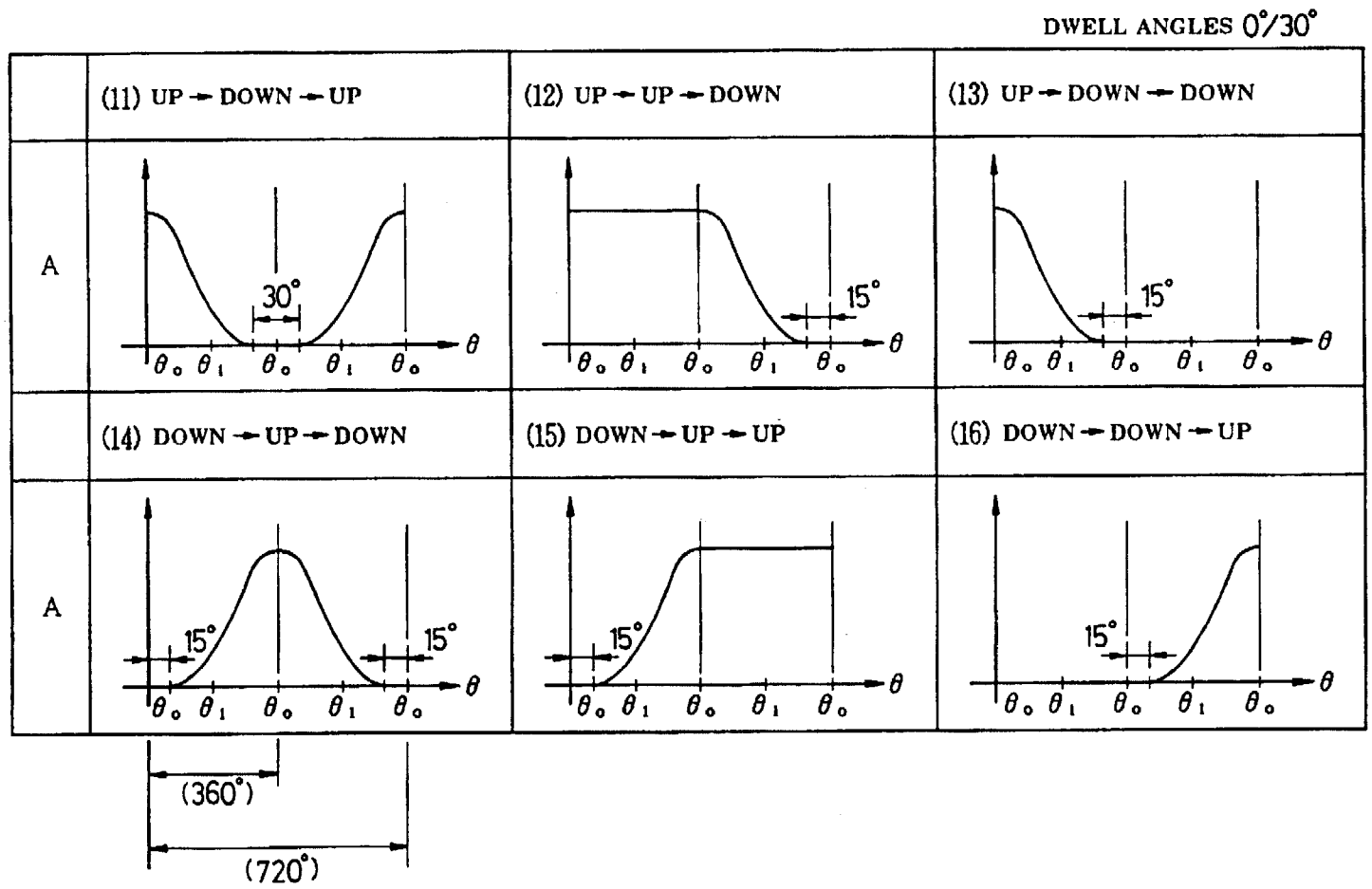
FIG. 17 is a view explaining other shedding patterns (shedding curves, target phase curves, base speeds, revolution phases)

Described hereinafter is the case where the setting interval of the shedding curves corresponds to two revolutions (two shedding operations) of the main shaft 7. FIG. 17 shows the shedding curves (11), (12), (13), (14), (15) and (16) as the shedding curves A which are to be stored in the memory 26. In these shedding curves A, two revolutions of the main shaft 7 are set to be one unit. The data of these shedding curves A are input to the memory 26 by the setting device 25 in the same manner as in the previous embodiment. Accordingly, the switching controller 28 reads the shedding selection instructions S in advance and stores two shedding curves A which are connected to each other in a state where the main shaft 7 performs two revolutions. The target phase curves, the base speed Vo and the rotation amount pulses Po, etc. are separately set corresponding to the shedding curves A in the same manner as shown in FIG. 4.

Figure 5:
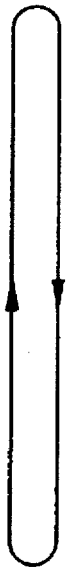
FIG. 5 is a table showing the relation between upward and downward movements of heddle frames and shedding curves for every shedding step with respect to each heddle frame.

FIG. 18 includes tables showing contents (steps) of setting of the shedding selection instructions S, which are set in the setting device 21. The upper table corresponds to the content of the table of FIG. 5 and shows the content of the data of the shedding selection instruction S before two shedding curves are connected to each other owing to two revolutions. The lower table in FIG. 18 shows the content of the shedding selection instruction S where two shedding steps 1·2, 3·4, and 5·6 are combined to each other for the heddle frame 2, thereby showing data synthesized as new shedding steps Sp 1, 2 and 3. The shedding selection instruction S is set in the following manner. (1) First, the shedding selection instructions S in the previous step, the present step, the next steps are respectively read. For example, the content of the No. 1 heddle frame 2 becomes "101". (2) Then, the corresponding shedding curve is selected from the shedding curves in FIG. 17. The content or instruction "101" of the No. 1 heddle frame 2 corresponds to the shedding curve (11). (3) Lastly, the shedding curve having the aforementioned content is set according to the shedding step 1 and stored. The aforementioned reading steps are applied to the other shedding steps 2 and 3, and the above setting manner of (1), (2) and (3) are repeated.

Meanwhile, the shedding instruction reading timings, the shedding instructions (heddle frames should be up/down) at each shedding steps are set in the setting device 21. When the setting is completed, the setting device 21 compares the shedding instruction in the previous step with that of the present step, thereby automatically selecting the number of the shedding curve corresponding to the present step among the shedding curves (11), (12), (13), (14), (15) and (16), and stores the selected number of the shedding curve in the memory 22 by way of the selection controller 23. Accordingly, the memory 22 stores sequentially one of the shedding curves together with the moving direction of the heddle frame 2, i.e. lowering "0" and rising "1" extending to one repeat shedding steps 1, 2 and 3 for every numbers (No.) of the heddle frame 2 in accordance with the lower table in FIG. 18.

Figure 19:
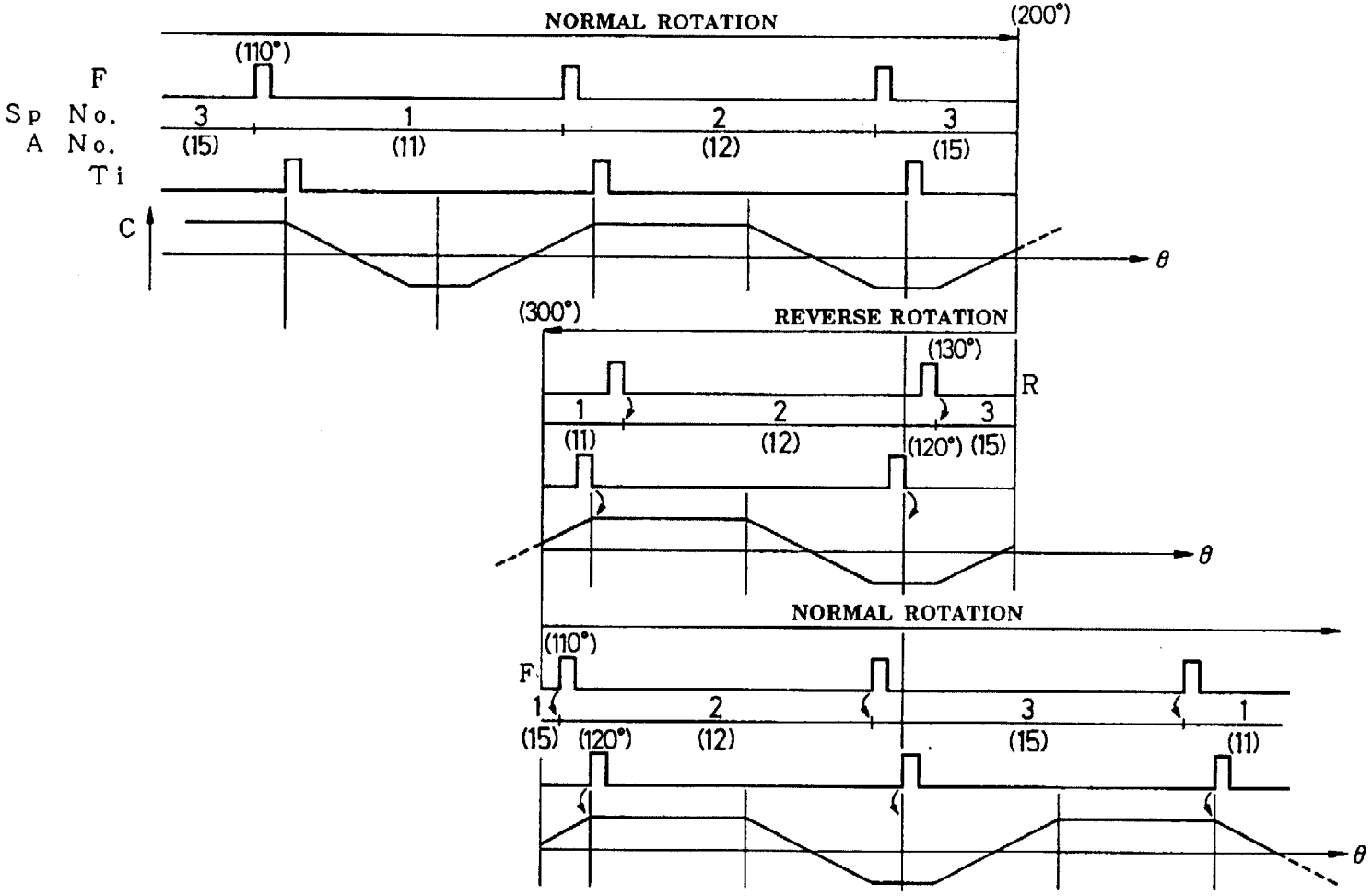
FIG. 19 is a view showing other shedding operations for one heddle frame at normal, inching and reverse rotations of a main shaft.

FIG. 19 shows a case for controlling the No. 1 heddle frame 2 where the main shaft 7 stops during the normal (weaving) operation, then it is reversed after inching operation and restarts the normal (weaving) operation. The stepping pulse F and the reverse stepping pulse R issued by the stepping signal generator 20 and the shedding switching timing Ti issued by the timing signal generator 27 are suitably set corresponding to the number of connection (the number of shedding curves to be connected).

Next, when the setting intervals of the shedding curves are set to be the intervals where the heddle frame 2 moves for the distance of 1/M, each shedding switching timing Ti is set in a manner that the starting point of each shedding curve is the angle of the main shaft at the maximum shedding state, and the end point thereof is a half revolution or one third revolution of the main shaft 7 from the starting point in the same manner as set forth above. Further, the setting interval of the shedding curves are not limited to the movement of the heddle frame 2 for the distance of M or 1/M but can be arbitrarily set, where M is an integer of 2 or more. More specifically, each shedding curve is divided into two so that the switching of the shedding curves is carried out in a state where the heddle frame 2 dwells, or it may be freely divided into two or three so that the switching of the shedding curves is carried out in a state where the heddle frame 2 is not limited to the dwelling thereof.

Meanwhile, the shedding curves may be selected in accordance with the operating state of the loom and availability information of the loom. In this case, the shedding curves may be selected according to the operating state of the loom such as an inching operation in the normal rotation, the reverse rotation, and the leveling operation other than the operations during the operation of the loom. In the course of selecting the shedding curves, the aforementioned technique (technique necessary for the interval where the heddle frame 2 moves for the interval of 1/M) is applied.

Figure 20:
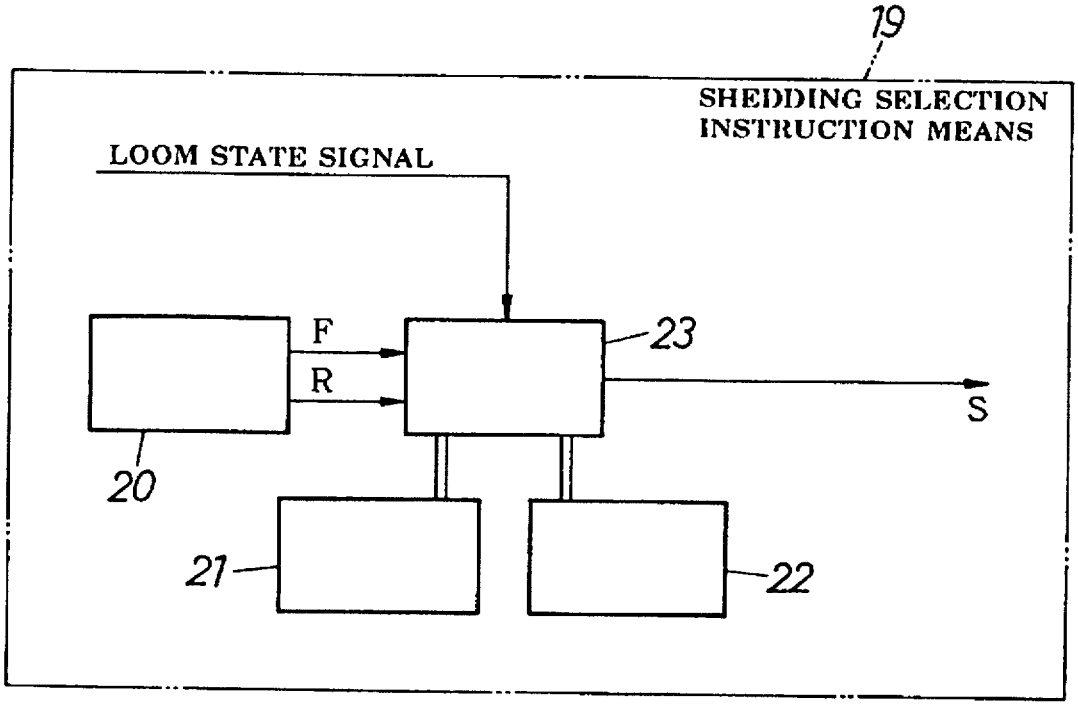
FIG. 20 is a block diagram of a shedding selection instruction means according to still another embodiment of the present invention.

More specifically, when the stop cause of the loom occurs, the loom is stopped. The warp shedding by controlling the heddle frame is leveled at a central shed by an automatic reverse rotation of the main shaft when pick finding or regulation of cloth fell is performed later. FIG. 20 shows a case where the state signals of the loom are outputted to the selection controller 23, thereby selecting the shedding curves in response thereto. A plurality of shedding instructions corresponding to the states of the loom are set in the setting device 21, and these shedding instructions are stored in the memory 22. The selection controller 23 counts up or down the number of shedding steps, upon reception of the stepping pulses F or the reverse stepping pulses R, then reads the operation state signals of the loom, thereafter reads the shedding instructions corresponding thereto, and finally outputs the read shedding instructions to the switching controller 28 as the shedding selection instruction S.

Figure 21:
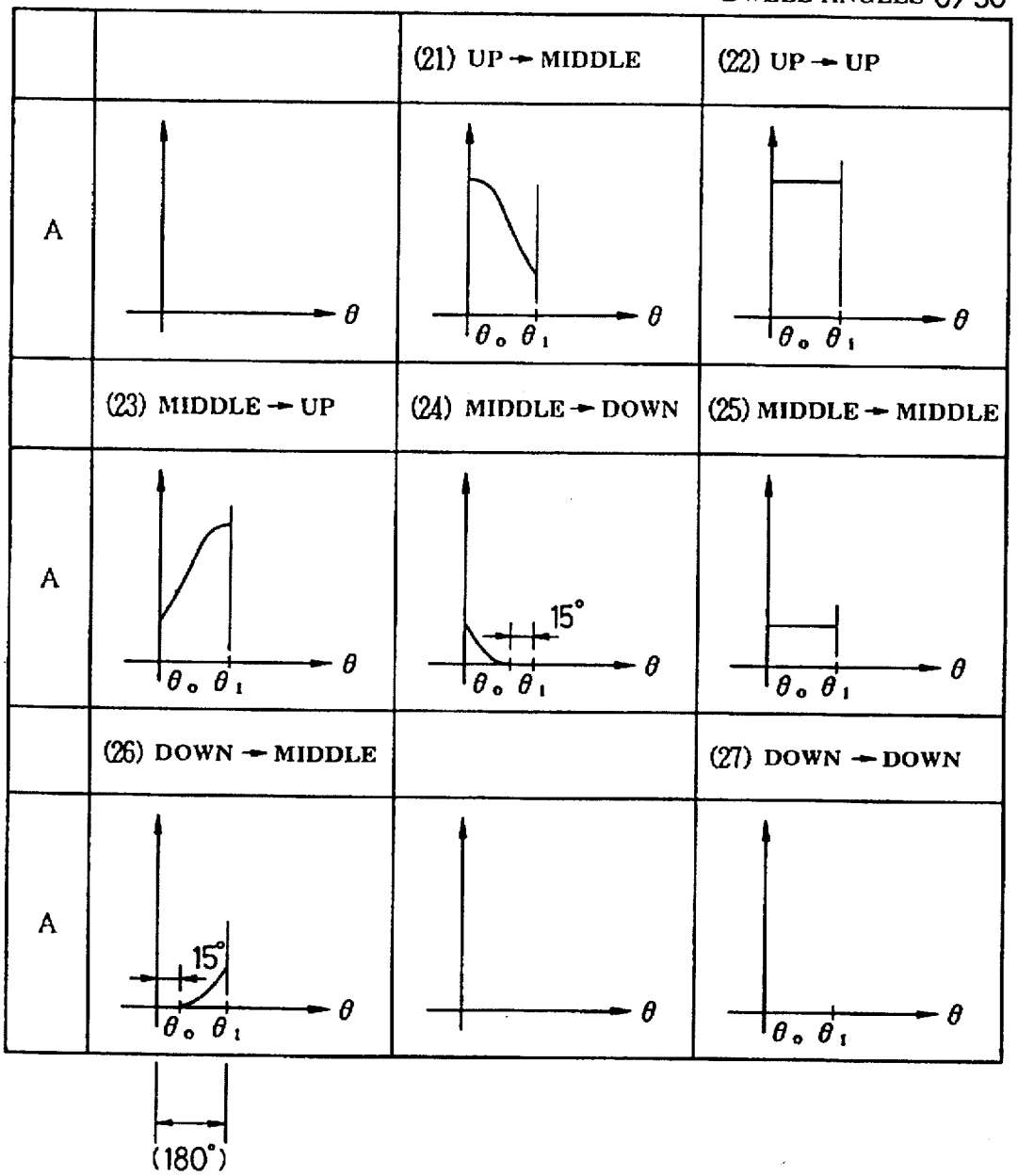
FIG. 21 is a view explaining shedding patterns (shedding curves)

FIG. 21 shows the shedding curves A to be stored in this case. The angle of the main shaft 7 involved in one movement of the heddle frame 2 (e.g., up →down) is 360°. If one revolution of the main shaft 7 is divided into two, the shedding curves may be prepared every 180° as the rotation angle of the main shaft 7. As a result, eight shedding curves are prepared as shown in FIG. 21.

FIG. 22 shows contents of setting of the shedding selection instructions S corresponding to the shedding steps Sp for every heddle frame 2. In the same figure, the above table in FIG. 22 is the same as the above table in FIG. 18, and the lower left table shows the shedding selection instructions in a state where the shedding curves are divided into two when the loom operates and the lower right table shows the shedding selection instructions in a state where the shedding curves are divided into two when the loom stops or the loom stops or dwells. The contents of setting of both the shedding selection instructions are set corresponding to the rotation angle of 180° of the main shaft. Explaining the No. 1 heddle, although the loom is immediately stopped when the stop cause is generated in the shedding step 2, the No. 1 heddle frame 2 is standby at the maximum shedding state as a result of operation of the pick finding or the regulation of the position of the cloth fell, that is, as a result of a series of operations involved in the reverse rotation of the loom until it reaches the given standby position after the stop of the inertial rotation of the loom. If the No. 1 heddle frame 2 is standby in this state, the warp extends and weaving bar caused by the stop of the loom is generated. To prevent the generation of such a weaving bar, the shedding curves are finely divided in advance, and the suitable shedding curves are selected depending on the stopping state. More specifically, even if the loom stops at a given angle of the main shaft 7, the pick finding operation or the regulation of the position of the cloth fell is performed in a state where the shedding curves are switched in advance to prevent the heddle frame 2 from remaining at the maximum shedding amount. The content of setting of the shedding selection instructions when the loom is stopped is an example taking into account such a condition. As mentioned above, the setting of the shedding curves is performed suitably by setting the interval of the shedding curves in addition to the constituents as set forth above. The interval of the shedding curves is set, for example, by considering the aforementioned setting condition of the loom (actuating position, stop position by the reverse rotation). The shedding curves are set corresponding to the operating states of the loom.

Figure 23:
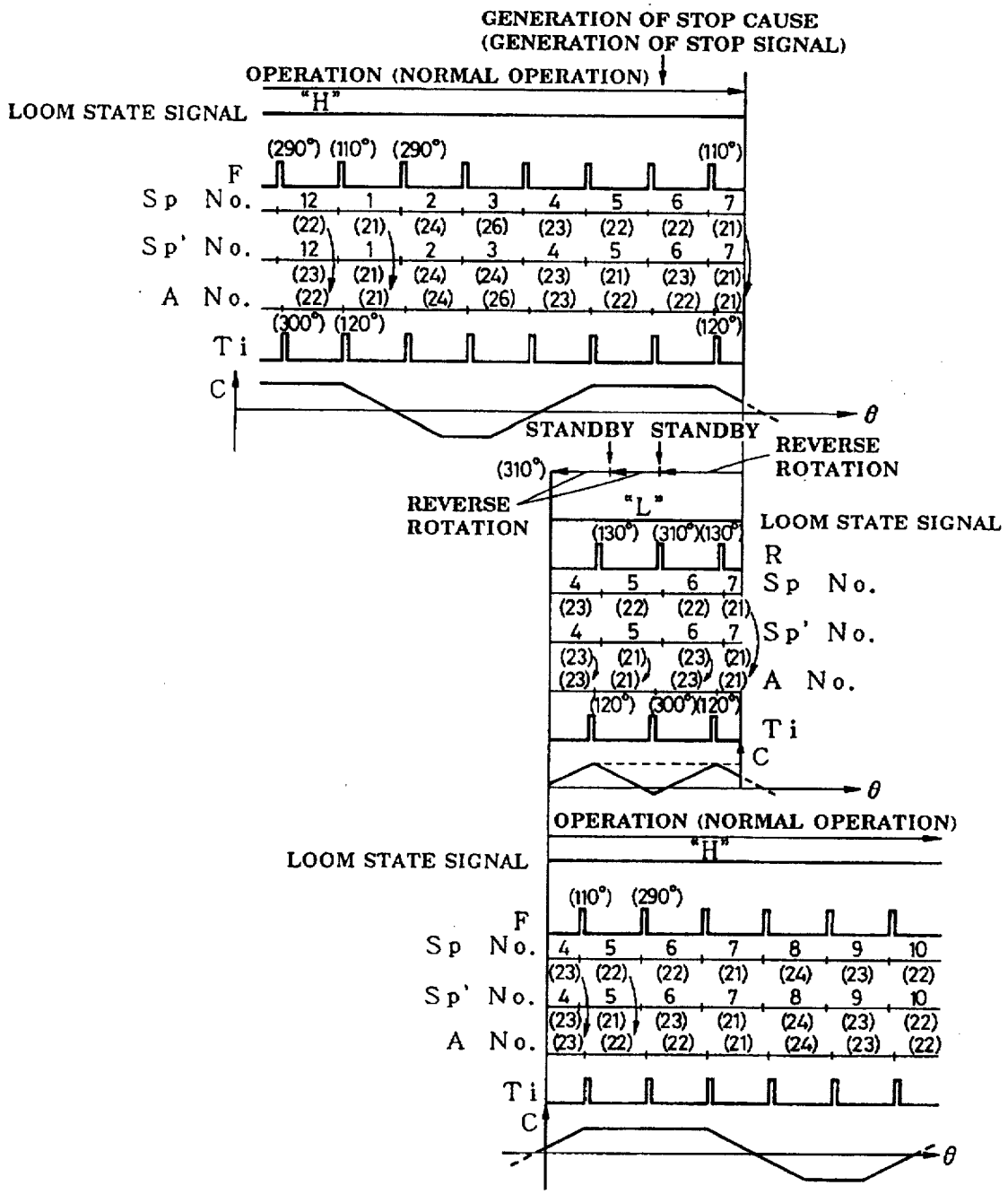
FIG. 23 is a view showing a shedding operation of one heddle frame at normal, inching and reverse rotations of a main shaft.

FIG. 23 shows a relation between the operation shedding steps Sp and stop shedding steps Sp' of the No. 1 heddle frame 2 during the course of the operation of loom, namely, when the loom stops after the operation (normal rotation) state owing to the generation of the stop cause, and reversely rotates at 310° while repeating the reverse rotation and standby state, and thereafter enters the normal rotation. The shedding curves A corresponds to a loom state signal. The loom state signal represents "H" when the loom is in an operation state and "L" when the loom is in a stop state. In the course of the reverse rotation of the loom, the shedding amount C is conventionally always constant as shown in dotted lines. However, when the shedding curves are employed, they form the shedding amounts C like the triangular waves. When the heddle frame 2 is in a center shedding state at the waiting position of 310°, to thereby adjust the elongation of the warps. The heddle frame 2 is in a shedding state when the loom reversely rotates thereafter, then the necessary operation such as the removal of the weft is easily performed at this state.

When the stop cause of the loom is generated, various modification are conceived in addition to the levelling of the warp shedding at the central shed. First, the loom state signals are not limited to those representing the operation or stop of the loom but includes the signal data relating generation of weaving bar such as the stop cause of the loom (weft stoppage, e.g. mispicking, warp stoppage, e.g. warp breakage) and a stop time, i.e., time involved in reactuation of the loom after the stop of the loom, and the automatic mending of the stop of the loom such as the operation signals of automatic mending device (weft mispicking removal apparatus). The state signals of these signals may be outputted as the loom state signals by alone or by the combination thereof. The shedding operations after the loom state signals are inputted, they are not limited to the leveling of the warp shedding at the central shed, but may include the leveling at the upper and lower sheds where the heddle frames 2 are all positioned at the same position, and the shedding amounts C are suitably set. The setting of each heddle frame 2 is performed independently to prevent the weaving shed from being moved or prevent the weaving bar from occurring in the manner of adjusting the elongation of the warps 9. Further, the time for switching the shedding curves in response to the loom state signals is not limited to the automatic reverse rotation of the loom for performing pick finding or regulation of the position of the cloth fell after the generation of the loom stop signal but may be the time immediately after the loom stop signal is generated, i.e., at the time of switching of the shedding curves during the rotation by inertia, or at the time when the loom reverse rotation/itching operation signal is generated, or at the time when the loom actuation signal is generated (the shedding curves are switched in response to the rising of the rotation of the loom). With the operations set forth above, the shedding curves are suitably selected in response to the operating state of the loom, thereby performing the shedding operation, leading to the saving of the storage capacities and the prevention of generation of the weaving bar.

Further, it is possible to select the shedding curves in response to loom availability information. As the availability data constituting the loom availability information, there are e.g., an availability factor of the loom, the number of warp stoppage, the number of weft stoppage, inspection (defect), etc. The availability information of the loom is operated by an availability information arithmetic unit installed on the loom or a host computer for concentratedly controlling the group of looms, and the thus operated availability information is transmitted to the switching controller 28. The switching of the shedding curves is performed based on operation data obtained by the availability data, i.e. based on the result of comparison when the number of stop of the loom according to the stop cause of the loom in a unit of time is compared with a predetermined threshold value. The threshold value is obtained by the value obtained by experience so far. If the shedding curves are selected in response to the availability of the loom, the shedding operation can be performed by selecting a suitable shedding curve corresponding to the availability information, leading to the saving of the storage capacities and improvement of the availability factor of the loom. For example, if the yarn is frequently cut, a previously set shedding curve (dwell and the shedding amount are respectively reduced) by which the warp is hardly cut is selected. If the weft mispicking is increased due to the inferior shedding, the shedding curve (dwell and the shedding amount are respectively increased) by which the traveling angle of the weft is increased is selected.

The present invention has various embodiments set forth above but it is not limited thereto, for example, it may be worked singly or by the combination of two or more embodiments.

What is claimed is:

1. A shedding control method in an electric shedding apparatus for driving each of a plurality of heddle frames independently in synchronization with rotation of a main shaft of a loom, said method comprising:

partitioning one repeating shedding pattern between maximum shedding positions for each cycle of said loom;

storing, in advance, partitioned shedding pattern constituents in a memory so that said partitioned shedding pattern constituents correspond to specified numbers;

storing, in advance, said repeating shedding pattern in said memory by partitioned shedding sequential step numbers and the corresponding specified numbers of said partitioned shedding pattern constituents;

selecting shedding patterns constituents corresponding to output steps based on step numbers which are output and conform to an amount of rotation of said loom main shaft, said stored partitioned pattern constituents, and said partitioned shedding sequential step numbers; and outputting an instruction of shedding amount for each of said heddle frames in accordance with the rotation of said main shaft based on the selected shedding pattern constituents, and switching the shedding pattern constituents by an angle of said main shaft which dwells at the maximum shedding state so as to drive said heddle frame.

2. The shedding control method as claimed in claim 1, wherein said partitioned pattern constituents are shedding curves which each correspond to one movement of one of said heddle frames.

3. A shedding control method in an electric shedding apparatus for driving each of a plurality of heddle frames independently in synchronization with a rotation of a main shaft of a loom, said method comprising:

setting, in advance, constituents forming a shedding operation;

measuring constituents relating to a delay of a shedding operation;

comparing measured constituent values with predetermined constituent values;

selecting said constituents for every shedding step of the shedding operation based on the results of the comparison between the measured constituent values and the predetermined constituent values; and outputting a shedding amount instruction for one of said heddle frames in accordance with the rotation of said loom main shaft based on shedding curves including said selected constituents, and thereby driving said one heddle frame.

4. The shedding control method as claimed in claim 3, wherein each of said shedding curves selected for said one heddle frame corresponds to one movement of said heddle frame.

5. The shedding control method as claimed in claim 3, wherein said selected shedding curves are connected to one another to form a shedding step, each shedding curve corresponds to one movement of said one heddle frame, and the number of shedding curves is two or more.

6. The shedding control method as claimed in claim 3, wherein said shedding curves comprise a repeating shedding pattern divided into two or more shedding curves which each correspond to one movement of said heddle frame.

* * * * *